US012075867B2

(12) United States Patent
Clarno

(10) Patent No.: US 12,075,867 B2
(45) Date of Patent: Sep. 3, 2024

(54) BEHAVIOR ENHANCEMENT AND GOAL-SETTING SYSTEM AND SLEEVE ARRANGEMENT

(71) Applicant: Anthony L. Clarno, Brookfield, IL (US)

(72) Inventor: Anthony L. Clarno, Brookfield, IL (US)

( * ) Notice: Subject to any disclaimer, the term of this patent is extended or adjusted under 35 U.S.C. 154(b) by 1269 days.

(21) Appl. No.: 16/397,876

(22) Filed: Apr. 29, 2019

(65) Prior Publication Data

US 2019/0340951 A1 Nov. 7, 2019

Related U.S. Application Data

(60) Provisional application No. 62/665,883, filed on May 2, 2018.

(51) Int. Cl.
*A41D 27/10* (2006.01)
*A41D 27/08* (2006.01)

(52) U.S. Cl.
CPC ..... *A41D 27/10* (2013.01); *A41D 27/08* (2013.01); *A41D 2400/32* (2013.01)

(58) Field of Classification Search
CPC ..... A41D 17/10; A41D 27/08
See application file for complete search history.

(56) References Cited

U.S. PATENT DOCUMENTS 4,164,910 A * 8/1979 Feiler ..... A63B 71/0672 273/DIG. 26
4,354,282 A * 10/1982 Langdon ..... A41D 1/04 273/DIG. 30
4,557,215 A * 12/1985 Petersson ..... A63B 71/0672 273/DIG. 26
4,683,594 A * 8/1987 Feinberg ..... A41D 13/1236 2/105
5,704,067 A * 1/1998 Brady ..... A41D 20/00 273/DIG. 26
2009/0265971 A1* 10/2009 Cook ..... G09F 3/005 224/267
2014/0093850 A1* 4/2014 Georgi ..... A44C 5/0015 434/238
2022/0232913 A1* 7/2022 Mehlert ..... A41D 27/08

* cited by examiner

*Primary Examiner* — Sally Haden
(74) *Attorney, Agent, or Firm* — Christopher J. Scott

(57) ABSTRACT

A behavior enhancement and goal-setting system and apparatus provides a user with a physical representation of the user's progress in an activity so as to reinforce behavior supportive of the activity. The basic behavior enhancement and goal-setting apparatus includes a sleeve and a series of activity reinforcement badges, including a foundation badge, and primary and secondary activity badges. The sleeve is formed from an elastic fabric material and includes proximal and distal open ends, and inner and outer sleeve surfaces. Activity reinforcement badges are attachable to the outer sleeve surface. The foundation badge is attachable to the outer sleeve surface. The distal foundation badge edge includes a series of primary activity badge alignment demarcations. The series of primary activity badge alignment demarcations are aligned end-to-end along a distal foundation badge edge for demarcating a series of activity badge alignment regions in distal adjacency to the distal foundation badge edge.

5 Claims, 17 Drawing Sheets

67

NINJA MONKEYS

Yellow 93 80 81 82 92

Rolling

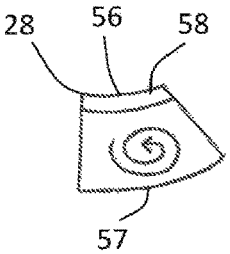

| Goals | Drills | Challenge |
|---|---|---|
| Turtle Roll | Down Wedge | Roll Standing, Up onto Wedge |
| | Wedge From Movement | Roll Across Panel Mat |
| | Kneel, Turtle, Kneel | Roll Across Trapezoid |
| Ninja Roll | One Foot on Wedge | Short v Long Roll |
| | Kneel, Roll, Kneel | Add Punches |
| | Stand, Roll, Stand | Add Blocks |
| Backward Roll (wedge) | Turtle Rocks | Roll Out of Safety Stick |
| | Off PacMan, Trapezoid | Roll out of Wall Run |
| | Down Wedge | NR into TR |

94 80 81 82 92

Flipping

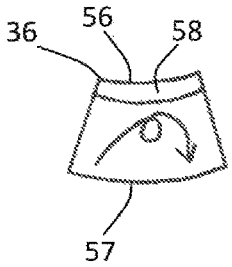

| Goals | Drills | Challenge |
|---|---|---|
| Lever Kick | Donkey Kicks | Feet on Obstacle, Hand Walks |
| | Levers w/o Jump | Bear/Crab Walk Obstacles |
| | On a Panel Mat | Switch Kick on Hands |
| Butterfly | Over a Mat | Nose and Toes to Wall |
| | Over a Low Beam | Connected Butterflies |
| | Kicking Over a Prop | Butterflies through Mats |
| Trampoline Shapes | Penguin Jumps all Directions | Plank Pops |
| | Cannonball, Split Kicks | Combination Jumps |
| | Doggy Jump, Seat Drop | 1/4 and 1/2 Turns |

95 80 81 82 92

Running

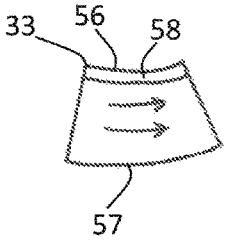

| Goals | Drills | Challenge |
|---|---|---|
| Precision Jump | From Running | Stick off Shoulder Height Mat |
| | Off Hip Height Mat | Stick Beam to Mat |
| | Mat to Mat (Precision) | Stick Mat to Beam |
| Safety Vault | Belly Vault | Vault Left, Vault Right |
| | One, Two, Thread Through | Connected Butterflies |
| | Over a Low Beam | Vault over Hip Height Mat |
| Wall Run | Wall Jump, Safety Fall | Vault off the Wall |
| | Wall Run, Safety Stick | Wall Jump 1/2 Turn |
| | Wall Run, Run Out of It | Two Step Wall Run |

FIG. 25A

BEHAVIOR ENHANCEMENT AND GOAL-SETTING SYSTEM AND SLEEVE ARRANGEMENT

PRIOR HISTORY

This application claims the benefit of pending U.S. Provisional Patent Application No. 62/665,883 filed in the United States Patent and Trademark Office on 2 May 2018.

BACKGROUND OF THE INVENTION

Field of the Invention

The present invention relates generally to a behavior enhancement and goal-setting apparatus, and more particularly to an apparatus that is wearable by the user that may be outfitted with badges designed to create a physical representation of a participant's progress or participation in any activity or sport with a predetermined curriculum and/or activity experience so as to reinforce positive behavior and skill development in the activity or sport.

Brief Description of the Prior Art

For many years it has been documented that there is a real benefit to creating reward systems in education and activities for children and adults. For example, the various scouting programs in America use badges, sewn onto a uniform, to denote accomplishments inside of their unique scouting programs. To explain this more specifically; as a child participates in and completes an activity a "Merit Badge" might be bestowed upon the child as a symbol for their having completed a task or learned a new skill. The badge and symbol constitute a reward for the accomplishment, which then inspires the child to learn more material to earn more badges.

Many schools are known to create "Gold Star" programs, or some variation thereof, which allow children to be recognized for academic or behavioral accomplishments in the classroom or institution with a gold star sticker or stamp. It has shown great success in generating motivation and holding children accountable for their choices. What's more, it allows parents and program administrators to hold professionals or volunteers accountable for the progress and inspiration of the children they are teaching.

Both the "Gold Star" and "Merit Badge" programs are very general examples of reward systems in the field of childhood education. While effective, neither of them was specifically created with the child athlete in mind. These reward programs were developed to be utilized in either the classroom or in combination with a uniform or sash that would not function safely in a high impact or fast paced activity like gymnastics, basketball or the martial arts.

For example, a child or person performing a summersault would not be safe wearing the equivalent of a Girl Scout's sash because it is not form fitting. It could become tangled and potentially cause injury during the exercise. The prior art thus perceives a need for a donnable activity-reinforcing apparatus, or article of manufacture that is both form-fitting and does not become tangled or create the potential for injury during target activity or behavior development as summarized in more detail hereinafter. It is the intention of the Achieve Sleeve activity-reinforcing apparatus according to the present invention described more fully hereinafter to recognize and encourage accomplishments by a participant for any activity or experience while also remaining safe to wear during the activity itself, regardless of the level of physicality.

SUMMARY OF THE INVENTION

Among the many objectives of this invention is the provision of a behavior enhancement and goal-setting apparatus for providing a user with a physical representation of the user's progress in an activity with a predetermined curriculum so as to reinforce behavior supportive of the activity. The behavior enhancement and goal-setting apparatus according to the present invention may be said to essentially comprise a sleeve, and a series of activity reinforcement badges, including a foundation or reference point badge, and primary and secondary activity badges.

The sleeve or sleeve-like article of manufacture is preferably formed from form-fitting fabric material having certain elasticity, and preferably comprises a proximal open end, a distal open end, an anterior side, a posterior side, a sleeve axis, an inner sleeve surface, and an outer sleeve surface. The outer sleeve surface primarily receives the activity reinforcement badges, and inner sleeve surfacing primarily opposes or engages a user's anatomical or skin surface as at the user's forearm or lower leg.

The foundation badge is preferably attached to the outer sleeve surface at the posterior side and proximal open end, and comprises a proximal foundation badge edge and a distal foundation badge edge. The distal foundation badge edge comprises a series of primary activity badge alignment demarcations that aligned end-to-end along the distal foundation badge edge for demarcating a series of activity badge alignment regions upon the outer sleeve surface in distal adjacency to the distal foundation badge edge.

The activity reinforcement badges according to the present invention, including the foundation or reference point badge, the primary activity badges, and the secondary activity badges, are preferably adhesively attachable to the outer sleeve surface. The behavior enhancement and goal setting apparatus according to the present invention further contemplates that at least one primary activity badge is preferably attachable to the outer sleeve surface at an activity badge alignment region in distal adjacency to the distal foundation badge edge.

The primary activity badge comprises a proximal primary activity badge edge and a distal primary activity badge edge. The primary activity badge further preferably comprises a foundation badge alignment demarcation at or adjacent the proximal primary activity badge edge. The foundation badge alignment demarcations help the user or participant align the primary activity badges with the foundation badge at or adjacent the distal foundation badge edge.

The distal foundation badge edge is preferably arcuate, the series of primary activity badge alignment demarcations each comprise a foundation badge demarcation arc length. The foundation badge alignment demarcation at the proximal primary activity badge edge comprises a primary activity badge demarcation arc length such that the primary activity badge demarcation arc lengths are greater in magnitude than the foundation badge demarcation arc lengths for aiding the user in aligning the primary activity badge in spaced relation to the distal foundation badge edge.

The series of primary activity badge alignment demarcations may preferably comprise primary activity badge-matching coloration, and the primary activity badges may preferably comprise foundation badge demarcation-matching coloration. The foundation badge demarcation-matching coloration aids the user or participant in aligning the primary activity badges in adjacency to corresponding portions of the foundation badge via a color-matched badge alignment demarcation pairing comprising corresponding primary activity badge alignment demarcations and foundation badge alignment demarcations. The color-matched badge alignment demarcation pairing may further comprise a first color shade, and each primary activity badge may further preferably comprise a second color shade distal to the foundation badge alignment demarcation within a symbol-bearing region of each primary activity badge.

The behavior enhancement and goal setting apparatus according to the present invention may further preferably comprise a series of bonus or secondary activity badges. Each secondary activity badge is also attachable to the outer sleeve surface in distal adjacency to the series of activity badge alignment regions at the posterior side and in proximal adjacency to the distal open end. The primary and secondary activity badges may both preferably comprise activity symbol markings that generally coincide with the activity that is to be reinforced.

BRIEF DESCRIPTIONS OF THE DRAWINGS

Other features and objectives of the invention will become more evident from a consideration of the following brief descriptions of patent drawings.

Figure 6:
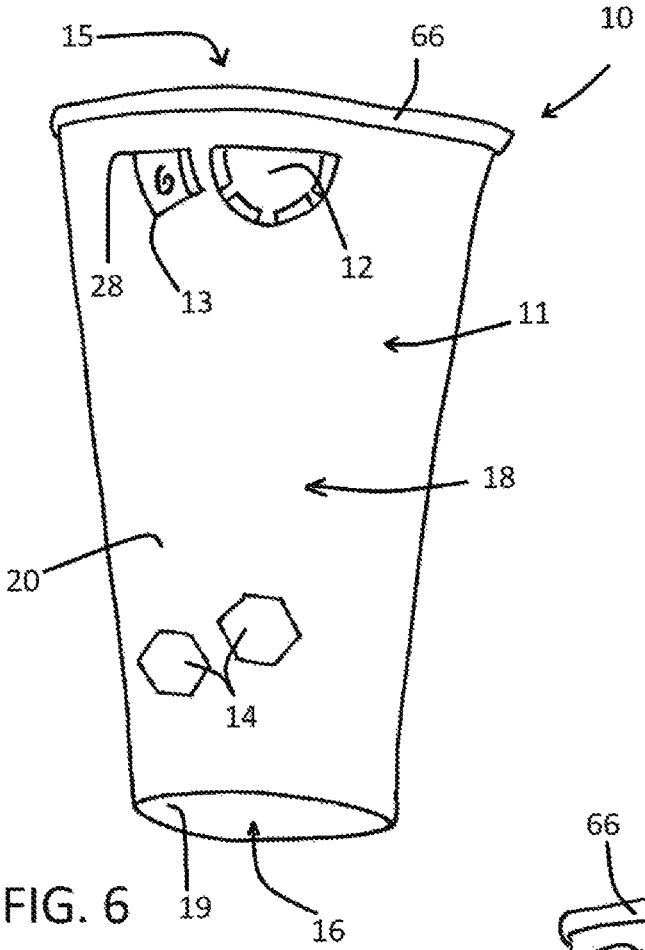

FIG. 6 is a third sequential slightly distal end view of the preferred sleeve element according to the present invention with a foundation or reference point badge having been firstly attached to the outer sleeve surface adjacent the proximal open end and a first primary activity badge being newly attached to the outer sleeve surface in adjacency to the foundation or reference point badge; and first and second secondary activity badges being attached to the outer sleeve surface adjacent the distal open end.

Figure 7:
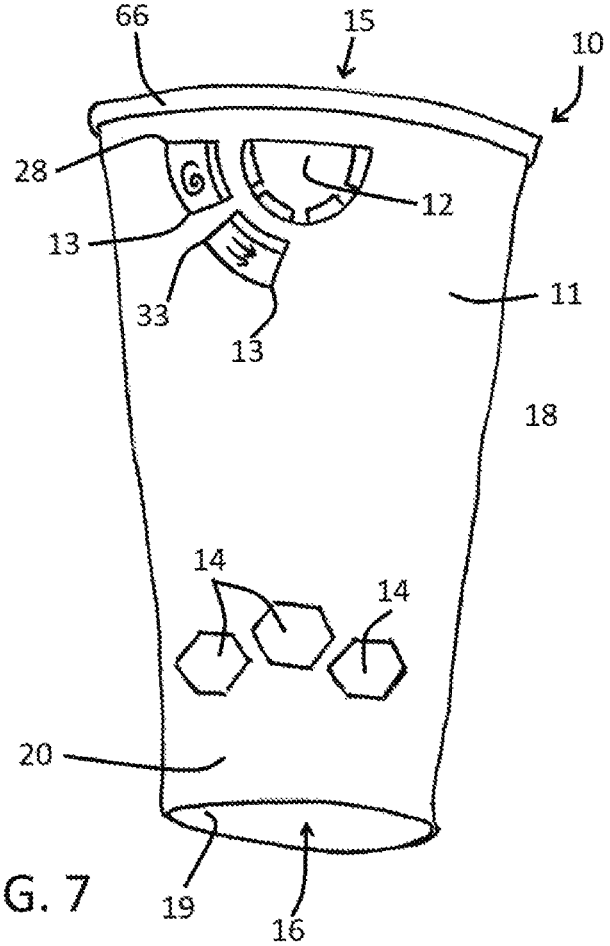

FIG. 7 is a fourth sequential slightly distal end view of the preferred sleeve element according to the present invention with a foundation or reference point badge having been firstly attached to the outer sleeve surface adjacent the proximal open end; a first primary activity badge having been previously attached to the outer sleeve surface in adjacency to the foundation or reference point badge; a second primary activity badge newly attached in adjacency to the foundation or reference point bade in lateral adjacency to the firstly attached primary activity badge; and three secondary activity badges being attached to the outer sleeve surface adjacent the distal open end.

Figure 8:
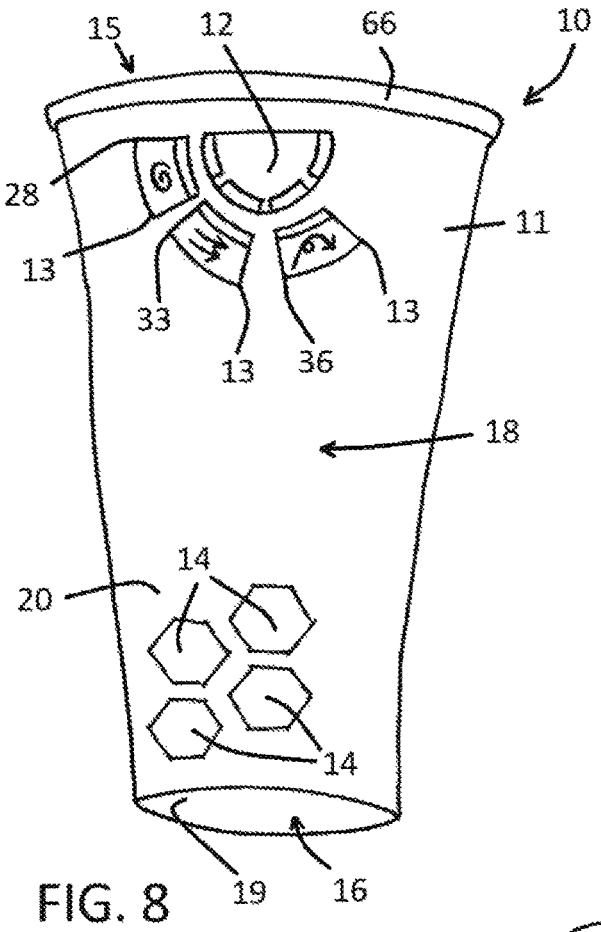

FIG. 8 is a fifth sequential slightly distal end view of the preferred sleeve element according to the present invention with a foundation or reference point badge having been firstly attached to the outer sleeve surface adjacent the proximal open end; a first primary activity badge having been previously attached to the outer sleeve surface in adjacency to the foundation or reference point badge; a second primary activity badge having been previously attached in adjacency to the foundation or reference point bade in lateral adjacency to the firstly attached primary activity badge; a third primary activity badge being newly attached in adjacency to the foundation or reference point bade in lateral adjacency to the secondly attached primary activity badge; and four secondary activity badges being attached to the outer sleeve surface adjacent the distal open end.

Figure 9:
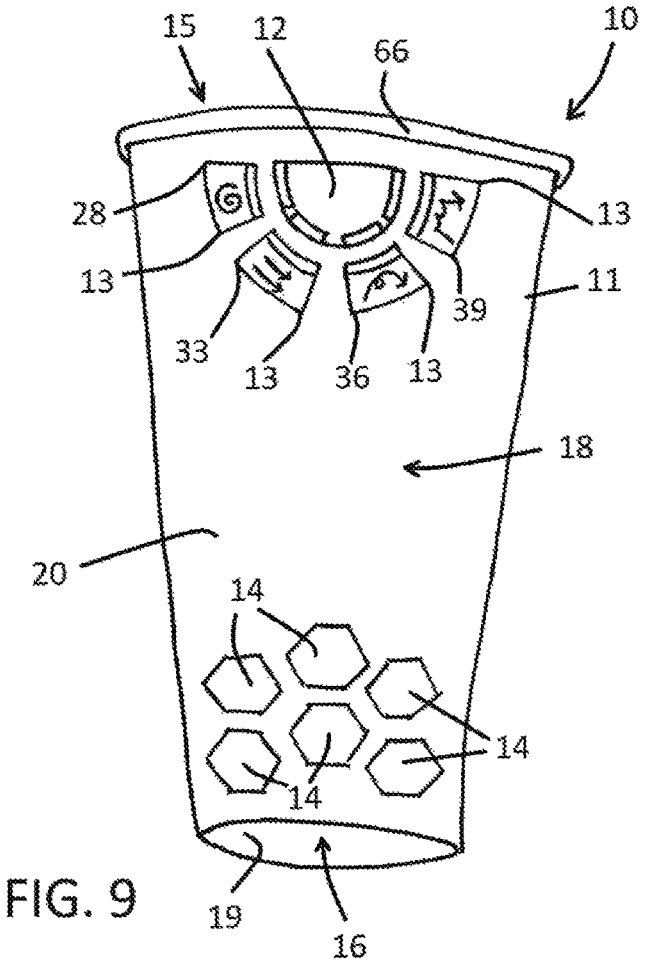

FIG. 9 is a sixth sequential slightly distal end view of the preferred sleeve element according to the present invention with a foundation or reference point badge having been firstly attached to the outer sleeve surface adjacent the proximal open end; a first primary activity badge having been previously attached to the outer sleeve surface in adjacency to the foundation or reference point badge; a second primary activity badge having been previously attached in adjacency to the foundation or reference point bade in lateral adjacency to the firstly attached primary activity badge; a third primary activity badge having been previously attached in adjacency to the foundation or reference point bade in lateral adjacency to the thirdly attached primary activity badge; a fourth primary activity badge being newly attached in adjacency to the foundation or reference point bade in lateral adjacency to the thirdly attached primary activity badge; and six secondary activity badges being attached to the outer sleeve surface adjacent the distal open end.

Figure 10:
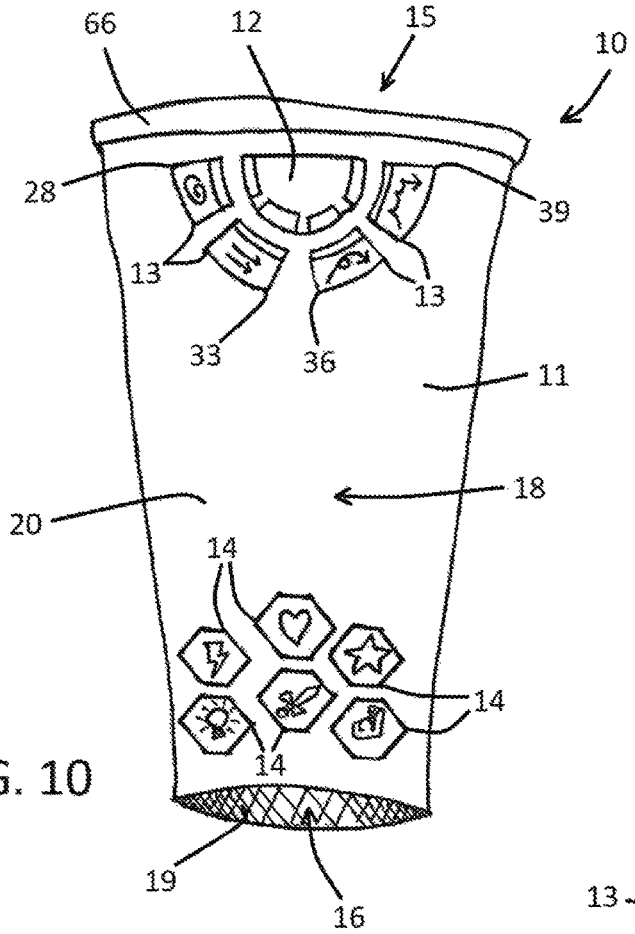
Figure 11:
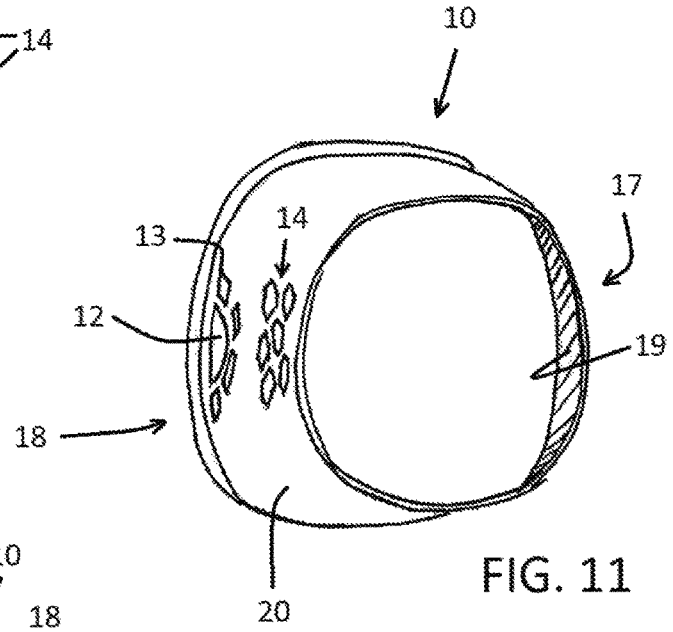
Figure 12:
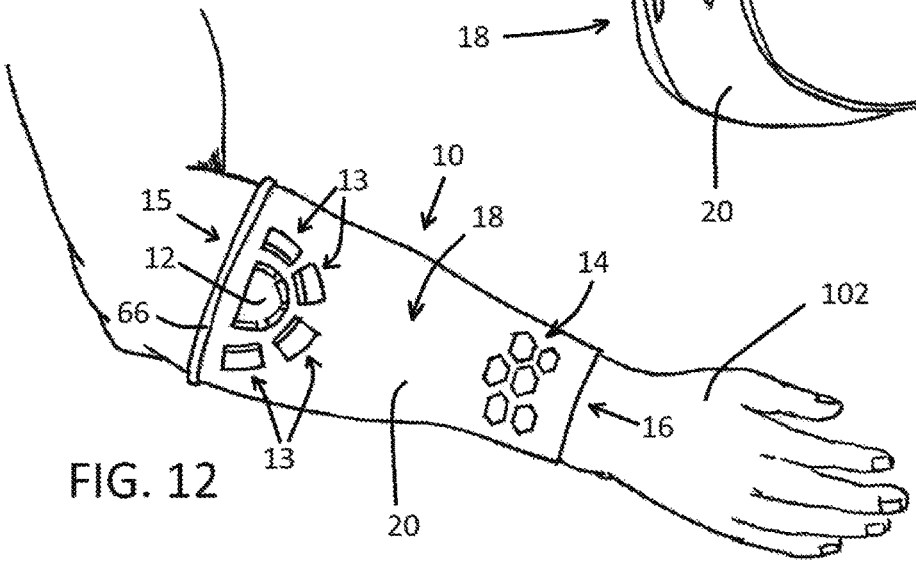

FIG. 10 is a slightly distal end view of the preferred behavior enhancement and goal-setting apparatus according to the present invention showing a foundation or reference point badge, a series of 4 primary activity badges, and a series of 6 secondary activity badges depicted in side-by-side relation to FIGS. 11 and 12 for ease of comparison therewith.

FIG. 11 is a distal end perspective view of the preferred behavior enhancement and goal-setting apparatus according to the present invention.

FIG. 12 is a perspective view of the preferred behavior enhancement and goal-setting apparatus according to the present invention as donned by a participant upon the participant's forearm.

Figure 13:
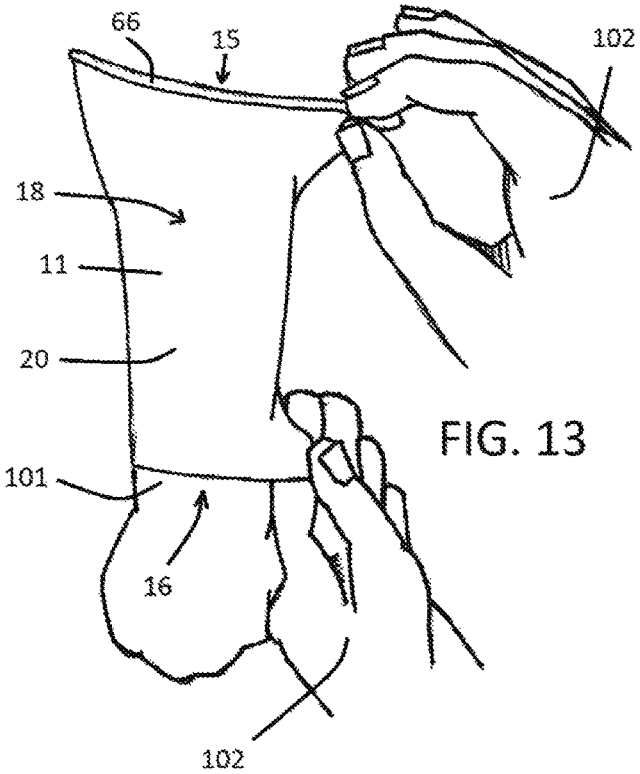

FIG. 13 is a perspective view of a preferred sleeve element according to the present invention as donned by a participant upon the participant's forearm with another person's hands actuating the proximal and distal open ends to demonstrate elasticity of the proximal and distal open ends of the preferred sleeve element.

Figure 14:
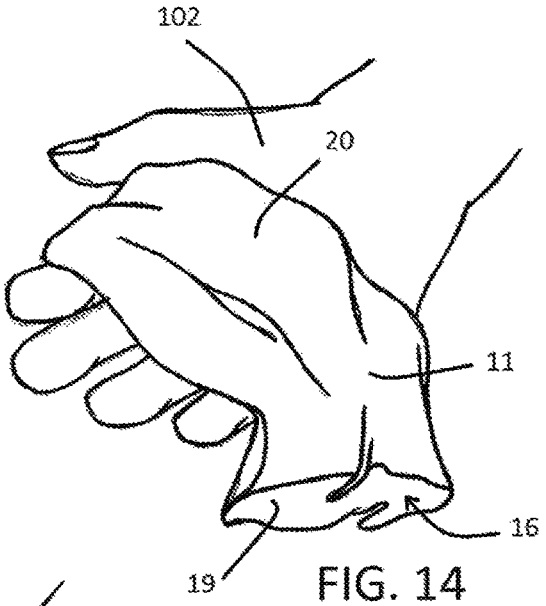

FIG. 14 is a perspective view of a preferred sleeve element in a relaxed state as removed from a participant's arm to demonstrate flexibility of the fabric material construction.

Figure 15:
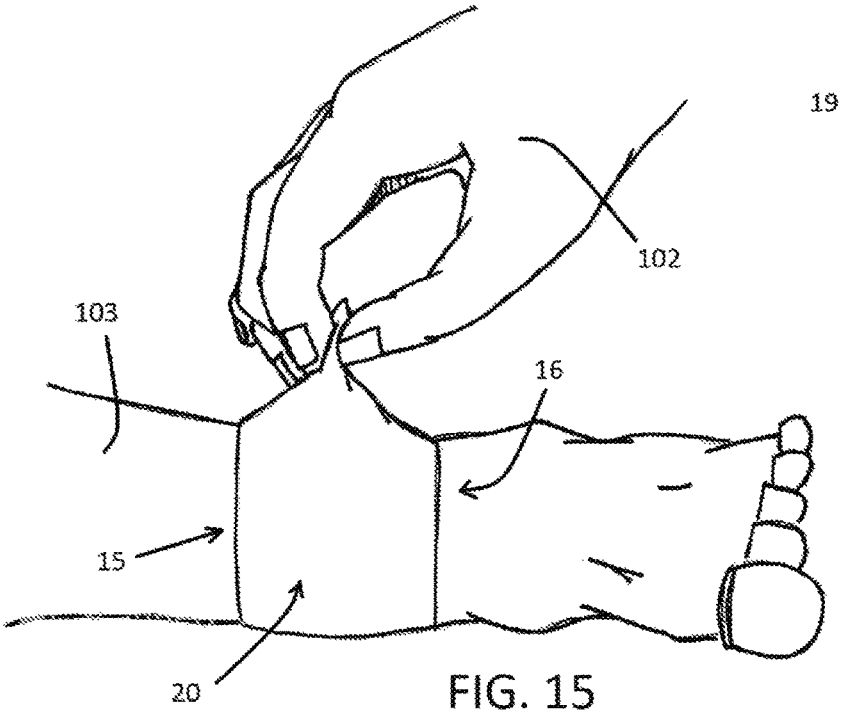

FIG. 15 is a perspective view of an alternative sleeve element according to the present invention as donned by a participant upon the participant's lower leg with another person's hand actuating the region intermediate the proximal and distal open ends to demonstrate elasticity of the region intermediate the proximal and distal open ends of the alternative sleeve element.

Figure 16:
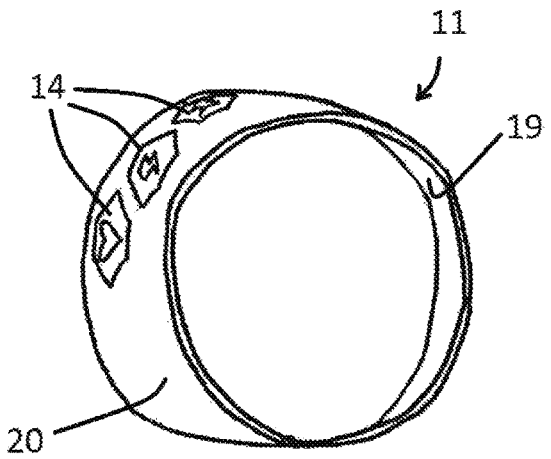

FIG. 16 is a distal end perspective view of the alternative sleeve element according to the present invention outfitted with a series of three secondary activity badges upon the outer sleeve surface.

Figure 17:
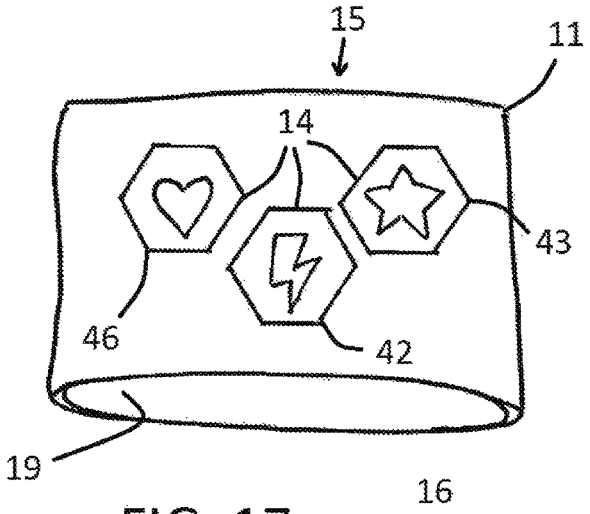

FIG. 17 is a slightly distal end view of the alternative sleeve element according to the present invention outfitted with a series of three secondary activity badges upon the outer sleeve surface.

Figure 18:
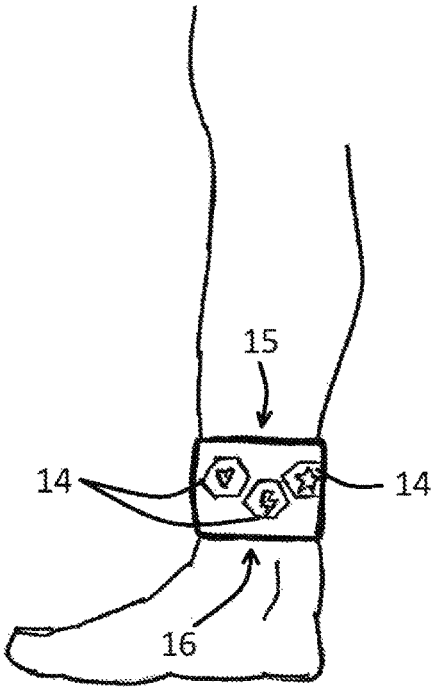

FIG. 18 is a side view depiction of the alternative sleeve element according to the present invention outfitted with a series of three secondary activity badges upon the outer sleeve surface as donned upon a participant's lower leg/ankle region.

Figure 19:
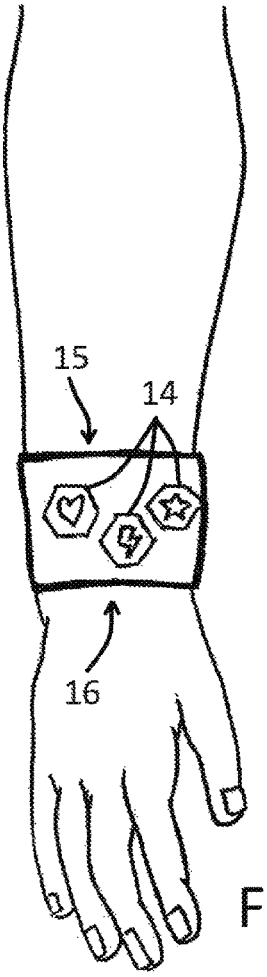

FIG. 19 is a side view depiction of the alternative sleeve element according to the present invention outfitted with a series of three secondary activity badges upon the outer sleeve surface as donned upon a participant's wrist region.

Figure 20:
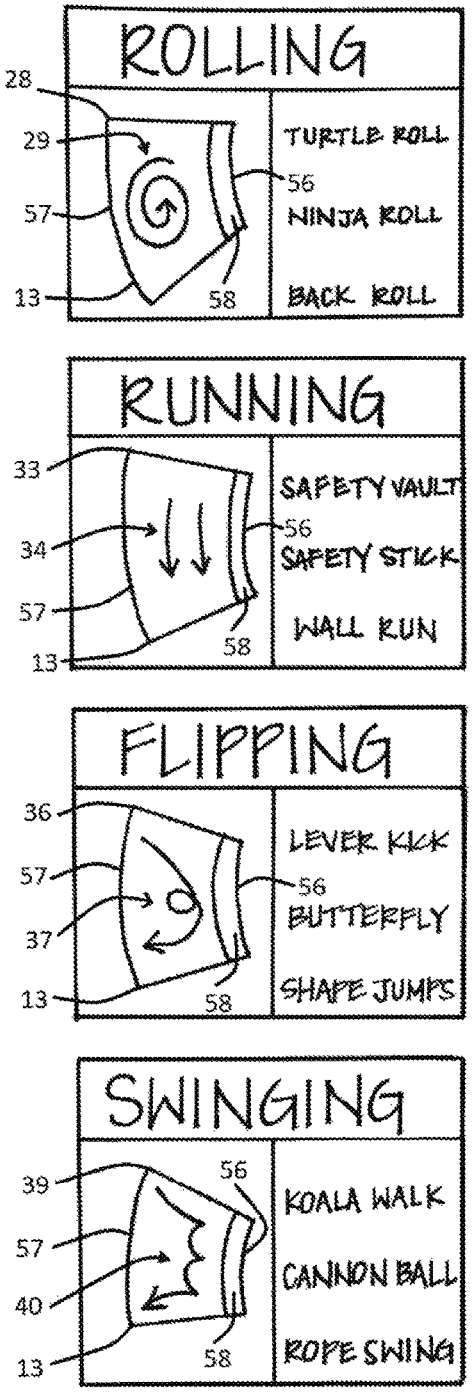

FIG. 20 is a tabular depiction of a series of four primary activity badges according to the present invention alongside textual primary skills associated with the four primary activity badges.

Figure 21:
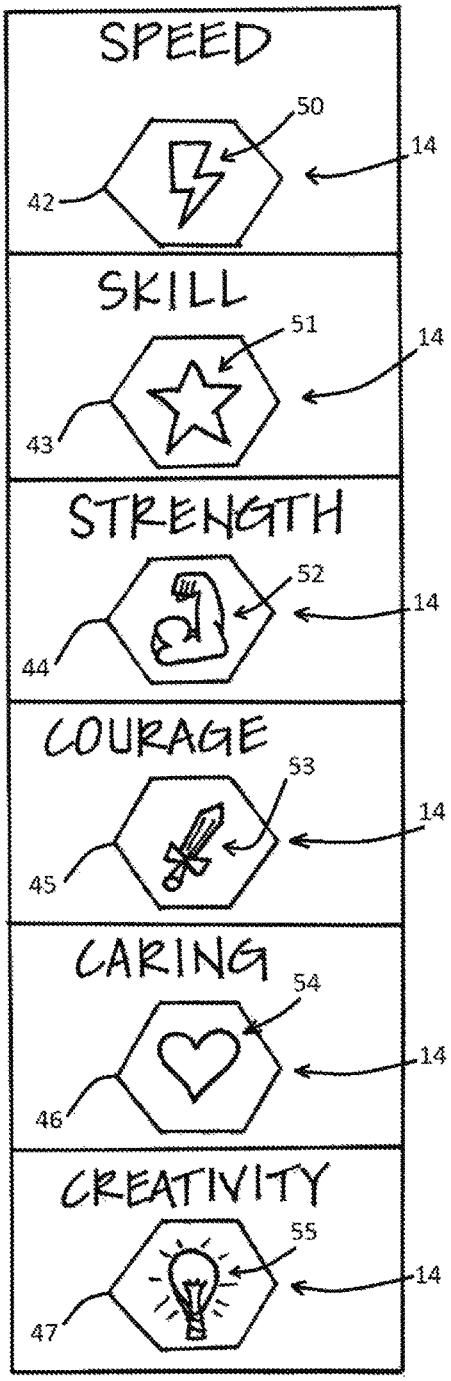

FIG. 21 is a tabular depiction of a series of six secondary activity badges according to the present invention alongside textual secondary categories associated with the six secondary activity badges.

Figure 22A:
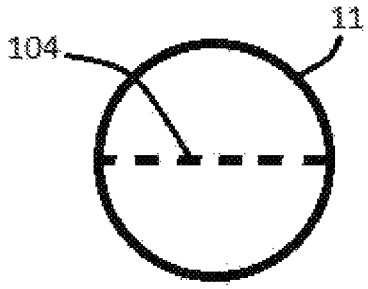

FIG. 22A is a diagrammatic depiction of a transverse cross-section of a sleeve element according to the present invention depicting the sleeve element in a relaxed state with a relaxed sleeve diameter.

Figure 22B:
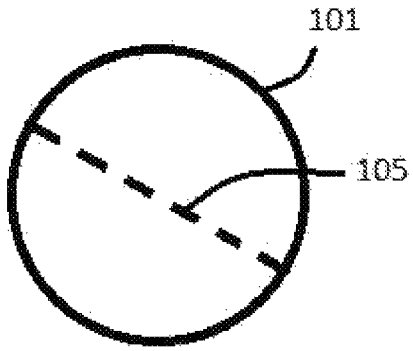

FIG. 22B is a diagrammatic depiction of a transverse cross-section of a participant's forearm depicting a relatively larger diameter of the participant's forearm as compared to the relaxed sleeve diameter otherwise depicted in FIG. 22A.

Figure 22C:
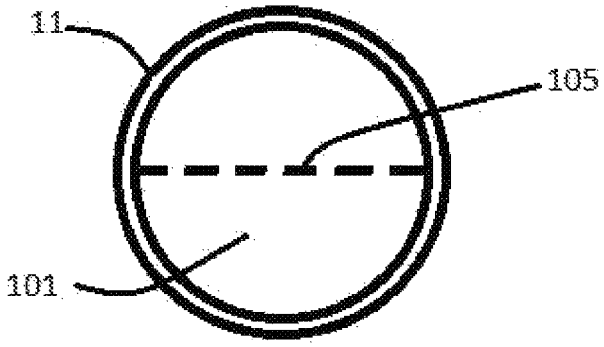

FIG. 22C is a diagrammatic depiction of a transverse cross-section of a participant's forearm depicting the diameter of the participant's forearm on par with an actuated sleeve diameter once donned upon the forearm of the participant.

Figure 23:
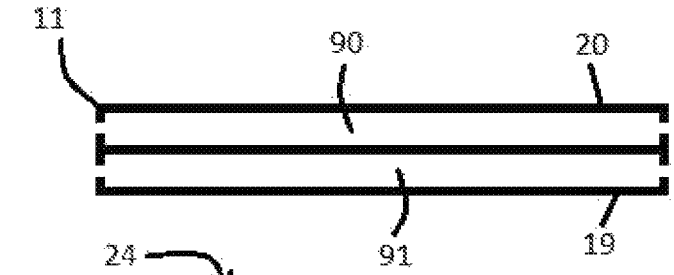

FIG. 23 is an enlarged, fragmentary diagrammatic depiction of a section of sleeve element depicting an upper, outer (hydrophilic) material layer and a lower, inner (hydrophobic) material layer.

Figure 24A:
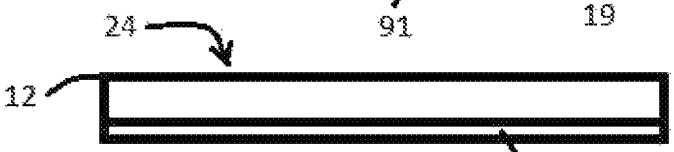

FIG. 24A is an enlarged edge view depiction of a foundation or reference point badge according to the present invention showing an upper, outer layer and a lower inner (adhesive) layer.

Figure 24B:
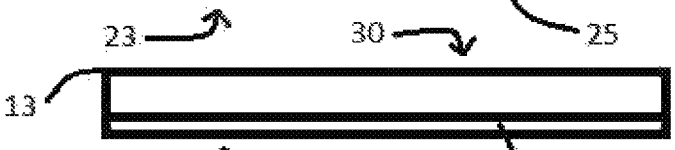

FIG. 24B is an enlarged edge view depiction of a primary activity badge according to the present invention showing an upper, outer layer and a lower inner (adhesive) layer.

Figure 24C:
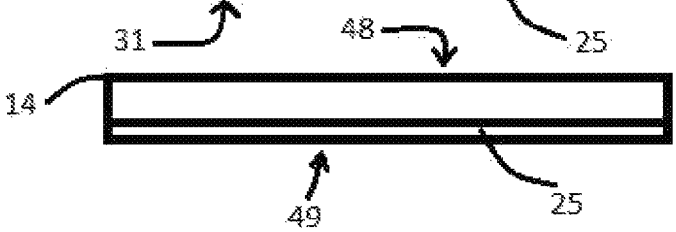

FIG. 24C is an enlarged edge view depiction of a secondary activity badge according to the present invention showing an upper, outer layer and a lower inner (adhesive) layer.

FIG. 25A is a first tabular depiction of a series of three exemplary primary activity curricula alongside primary activity badges associated therewith.

Figure 25B:
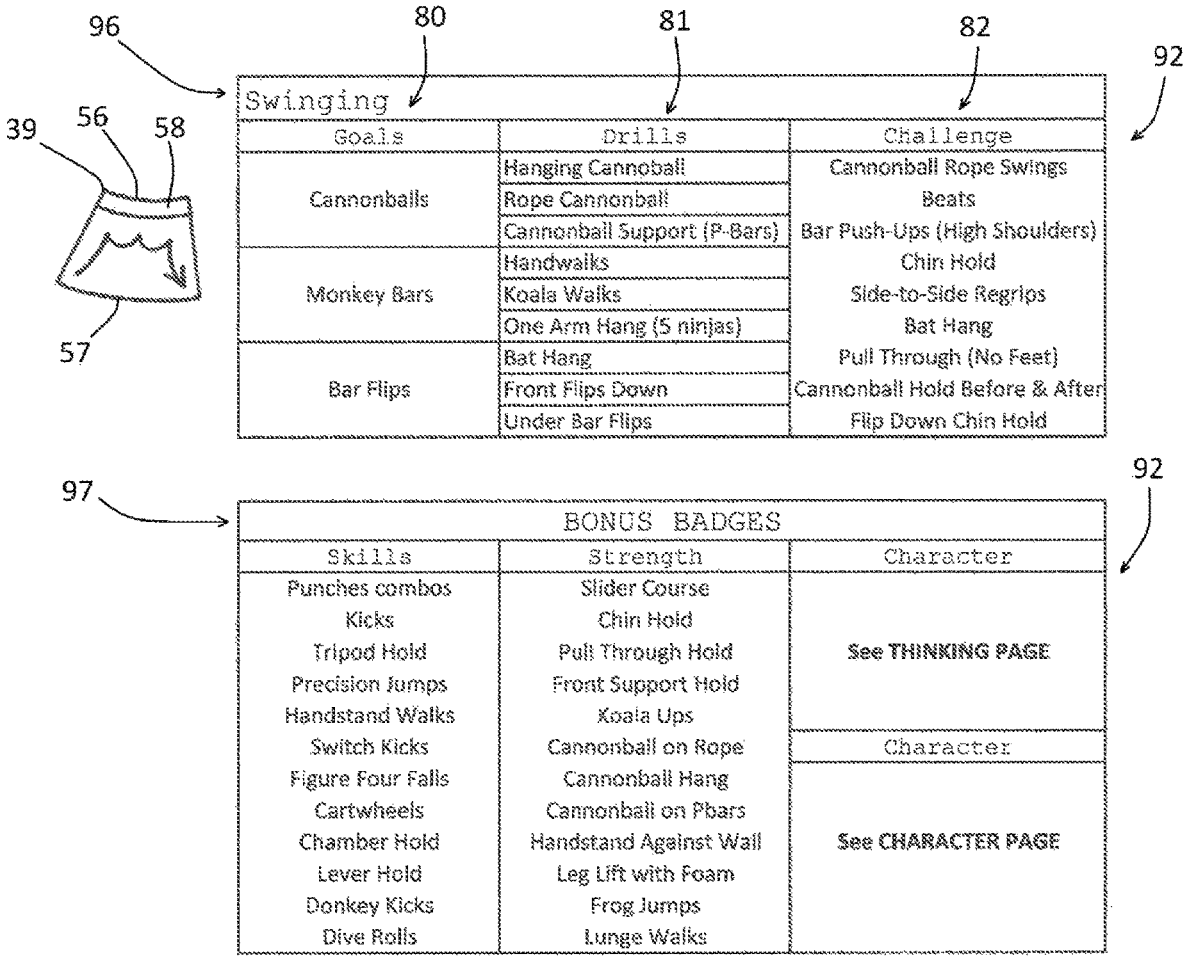

FIG. 25B is a second tabular depiction of an exemplary primary activity curriculum alongside a primary activity badge associated therewith and an exemplary secondary activity curriculum.

Figure 26:
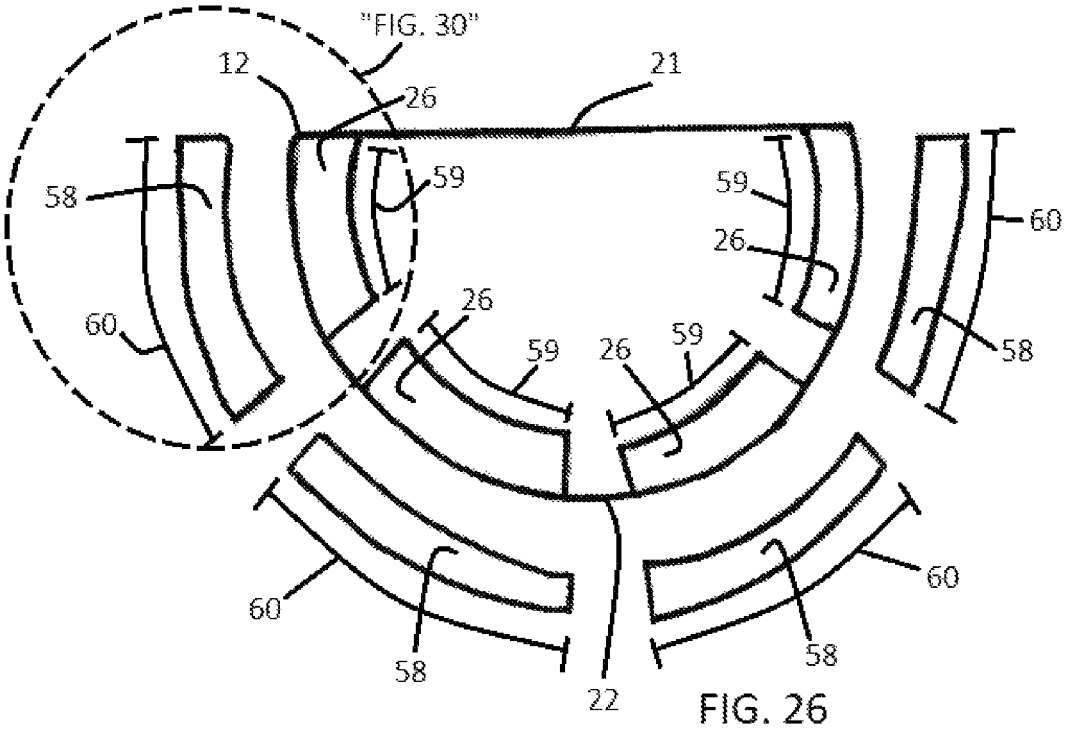

FIG. 26 is an enlarged plan view of a central foundation or reference point badge according to the present invention depicting arc lengths of primary activity badge alignment demarcations as juxtaposed adjacent foundation badge alignment demarcations with relatively arc lengths thereof being further depicted.

Figure 27:
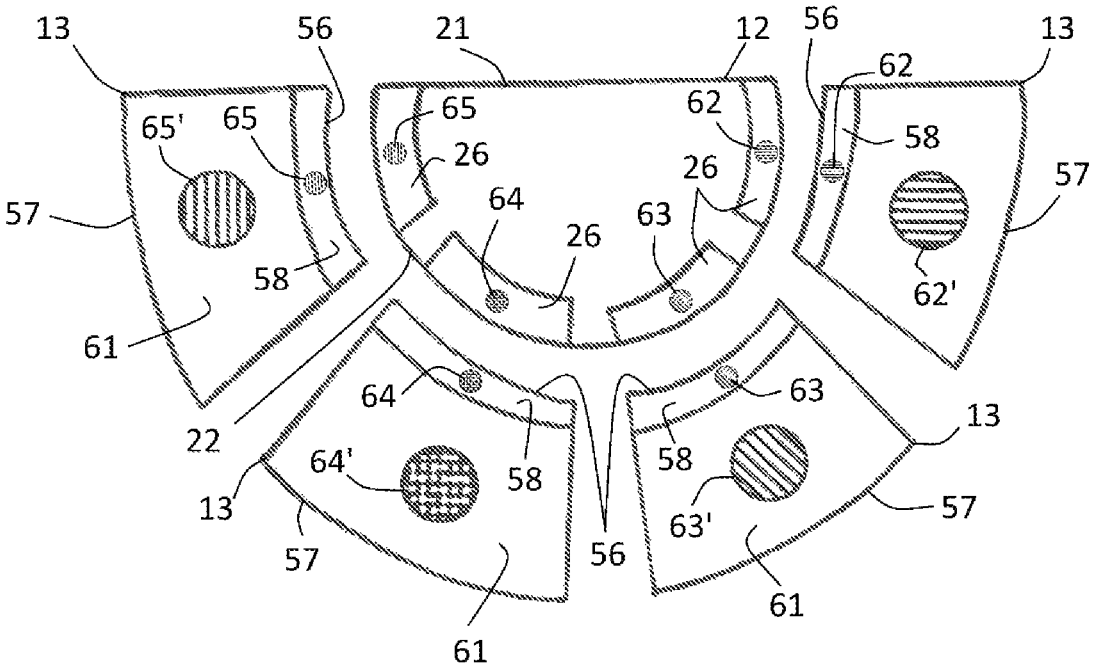

FIG. 27 is an enlarged plan view of a central foundation or reference point badge according to the present invention with a series of primary activity badges positioned or aligned in adjacency thereto and depicting color-coded pairing between the primary activity badge alignment demarcations of the foundation badge and the foundation badge alignment demarcations of the primary activity badges.

Figure 28:
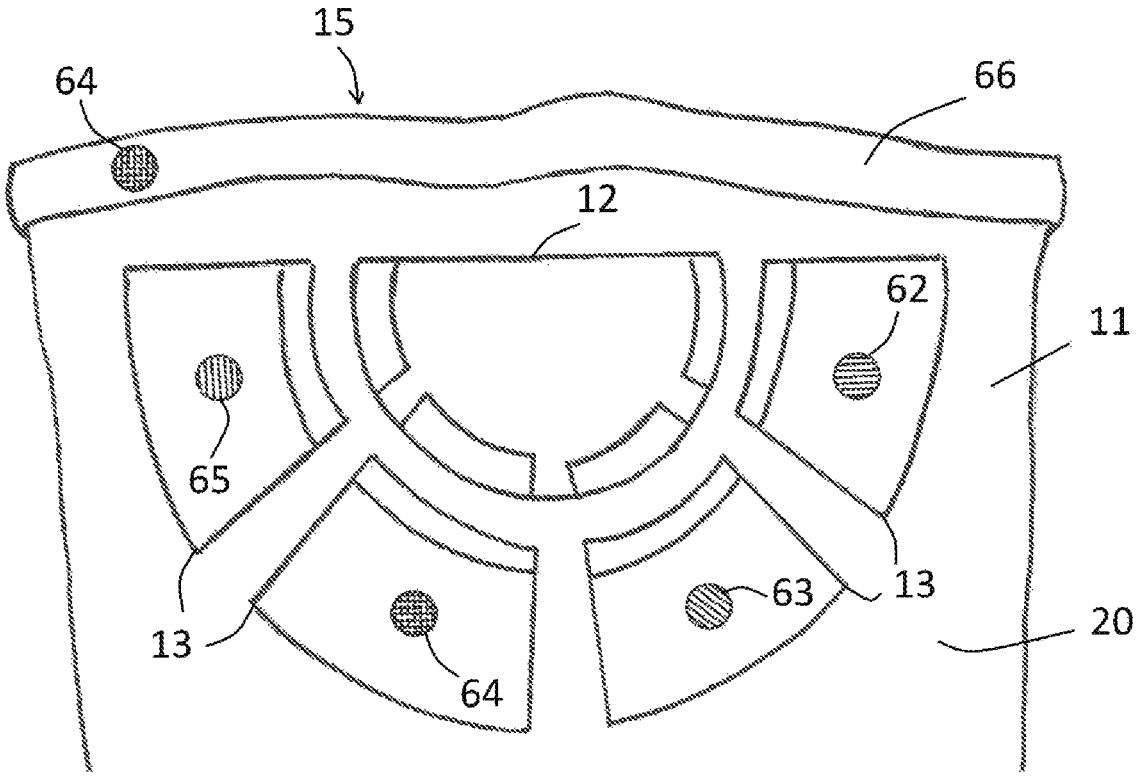

FIG. 28 is an enlarged, fragmentary depiction of proximal portions of the preferred behavior enhancement and goal-setting apparatus according to the present invention showing an upper boundary edge outfitted with first coloration to depict an entry level behavior enhancement and goal-setting apparatus.

Figure 29:
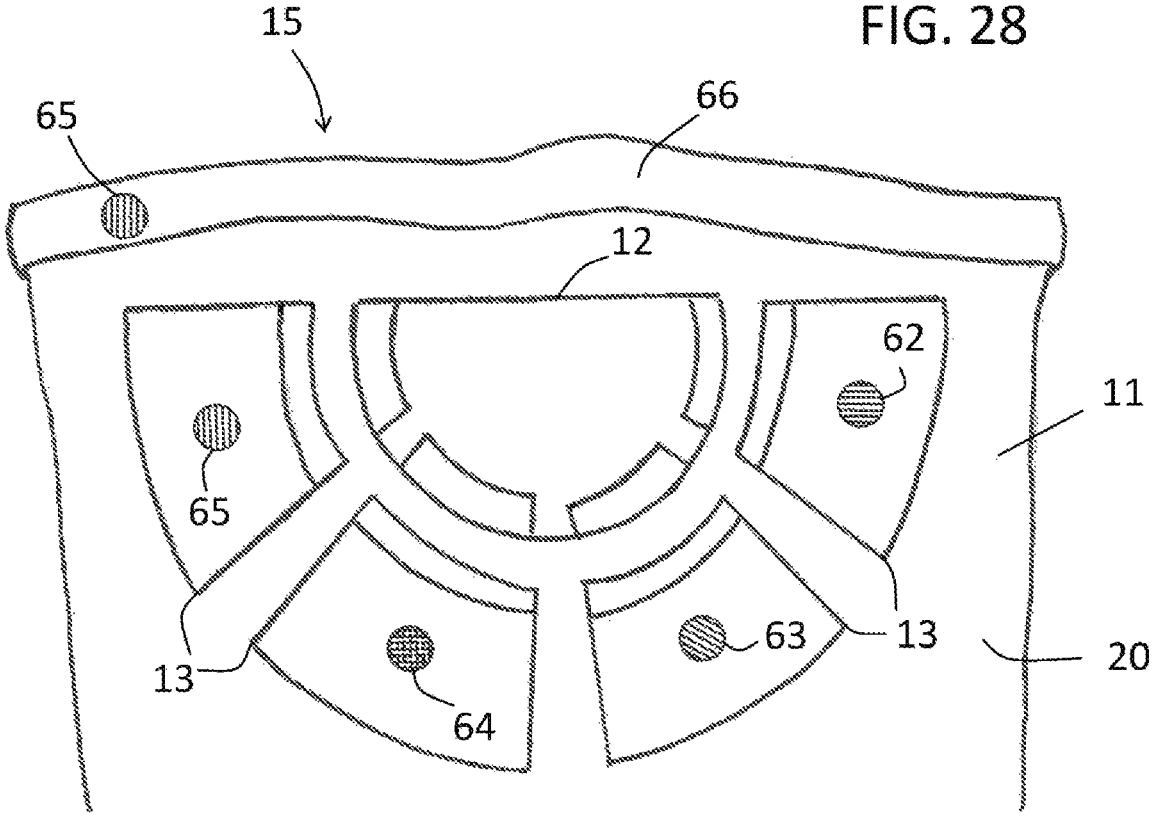

FIG. 29 is an enlarged, fragmentary depiction of proximal portions of the preferred behavior enhancement and goal-setting apparatus according to the present invention showing an upper boundary edge outfitted with second coloration to depict an advanced level behavior enhancement and goal-setting apparatus.

Figure 30:
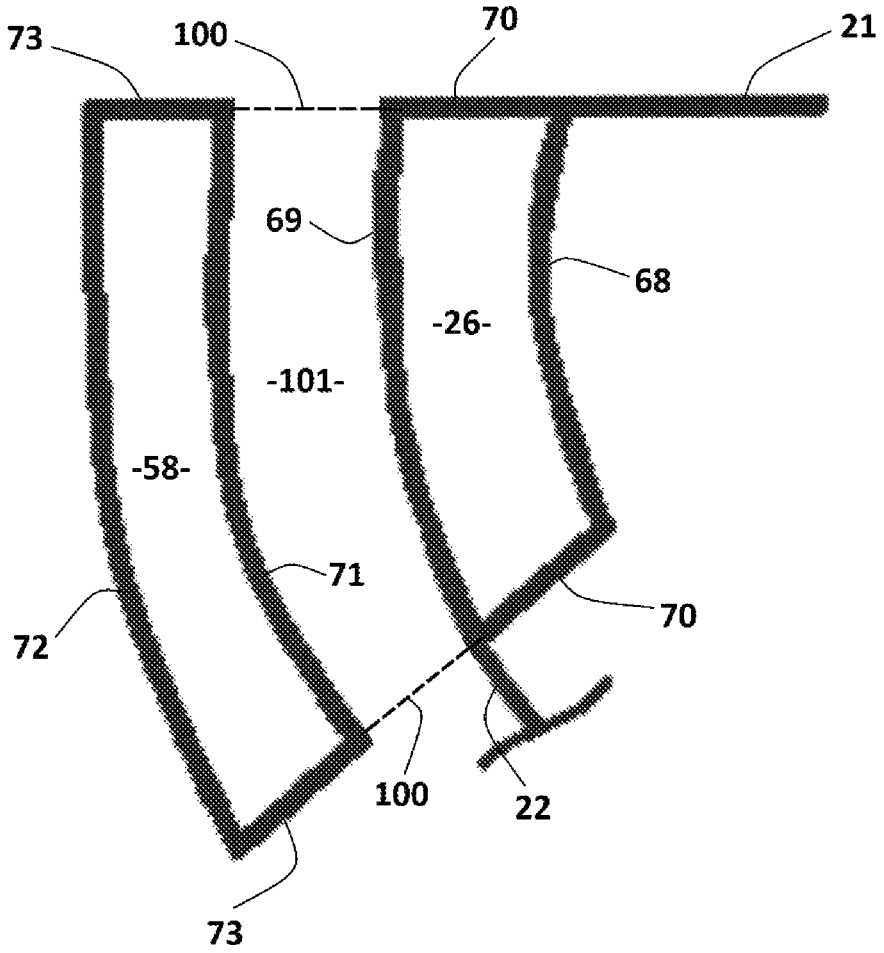

FIG. 30 is an enlarged, fragmentary sectional view as enlarged and sectioned from FIG. 26 to more clearly depict the juxtaposition of a primary activity badge alignment demarcation and a foundation badge alignment demarcation according to the present invention.

DETAILED DESCRIPTION OF THE PREFERRED EMBODIMENT(S)

Referring now to the drawings with more specificity, the following specifications generally describe a behavior enhancement and goal-setting apparatus or article of manufacture for providing a user or participant with a physical representation of the user's progress in an activity (e.g. gymnastics activity) having a predetermined curriculum or curricula as at 92 so as to reinforce behavior in the activity (e.g. gymnastics activity). The preferred behavior enhancement and goal-setting apparatus 10 or sleeve arrangement according to the present invention may be said to essentially comprise a sleeve or sleeve-like article of manufacture as at 11 and a series of activity or behavior reinforcement badges as variously exemplified. The activity or behavior reinforcement badges according to the present invention may preferably include at least one foundation or reference point badge as at 12, at least one primary activity badge as at 13, and at least one secondary activity badge as at 14.

The behavior enhancement and goal-setting apparatus 10 according to the present invention is built upon a sleeve or sleeve-like article of manufacture otherwise referred to as the "Achieve Sleeve" preferably created from the same form-fitting materials as a gymnastics leotard (cotton, spandex, nylon, etc.). The gymnastics leotard is a product specifically designed to keep athletes safe during the most challenging and dangerous of exercises, meaning it uses materials that are known to be safe and appropriate for the rigors of the sport. By using similar fabrics and design concepts the Achieve Sleeve or sleeve 11 is able to take advantage of the safety practices that have already become an industry standard in sporting activities as exemplified by gymnastics.

Figure 1:
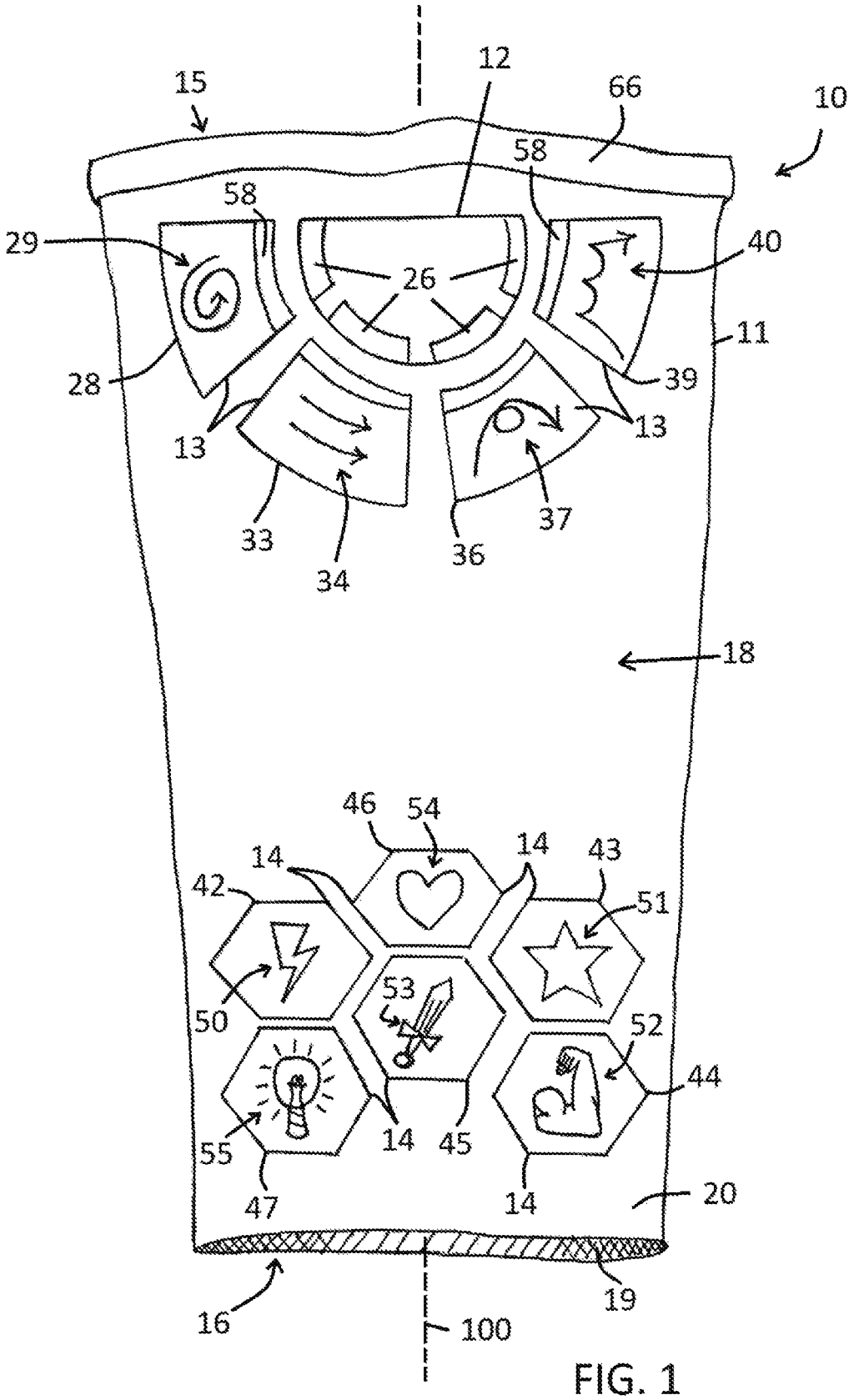
FIG. 1 is a slightly distal end perspective view of a preferred behavior enhancement and goal-setting apparatus according to the present invention.

The preferred placement of the Achieve Sleeve on the participant's body derives from safety concerns. The sleeve 11 is preferably placed on the forearm between the wrist and elbow, making it an ideal location for product visibility while delivering no meaningful obstruction to the performance of any activity. By considering FIG. 1, the reader will note that the sleeve 11 formed so as to preferably conform to a forearm's uniquely conical shape. The distal open end 16 comprises a relatively narrow diameter adjacent the wrist and gradually widens out around the bulk of the forearm. It can be made of any skin-engaging, appropriate materials that have flexibility so as to fit like a snug sock. Looseness may create the potential for distraction during exercises, or even inhibit the performance of skills and activities.

Conceivably, a multitude of fabric varieties and decorative elements may be used in the construction or formation of the sleeve 11. Accordingly, the sleeve 11 may be formed from inexpensive cotton or a higher quality hydrophobic, moisture-wicking fabric blend 91 while still achieving the intent of the product. In addition, the sleeve 11 may be outfitted with colorful bindings or fabric piping on either end, near the wrist or elbow or both, that advertise company colors or telegraph certain benchmarks in a program. A user could also add accoutrements, such as rhinestones or heat transfer logos, so long as the accoutrements do not inhibit the safety or effectiveness of the sleeve 11.

The sleeve 11 should be made of any fabric that allows for the adhesion of the uniquely designed Achieve Sleeve activity reinforcement badges as described in more detail hereinafter. The activity reinforcement badges according to the present invention have been created to adhere to cotton or cotton blends for best effectiveness, so it is the recommendation that the sleeve 11 be formed from such hydrophilic materials 90 at least at an outer layer or surfacing 20 of the sleeve or sleeve-like articles of manufacture 11.

The preferred sleeve or sleeve-like article of manufacture 11 is preferably formed from a fabric material having a certain degree of form-fitting elasticity. FIGS. 13-15 attempt to depict the sleeve or sleeve-like article of manufacture 11 in various conditions of use. FIG. 13 depicts a sleeve or sleeve-like article of manufacture 11 worn by the user upon the user's forearm as at 101 with a pair of hands 102 stretching the fabric material at the proximal open end 15 and distal open end 16 to depict elasticity of the fabric material at the ends 15/16. FIG. 14 attempts to depicts the sleeve or sleeve-like article of manufacture 11 removed from the user and being held aloft in a user's hand 102 in a relaxed state. FIG. 15 attempts to depict the sleeve or sleeve-like article of manufacture 11 as donned upon a user's lower leg 103 with a hand stretching the fabric material intermediate the proximal open end 15 and the distal open end 16 to demonstrate elasticity of the fabric material at the region intermediate the proximal and distal open ends 15/16.

Comparatively referencing FIGS. 22A through 22B, the reader will there consider certain diagrammatic depictions of the sleeve or sleeve-like article of manufacture 11 in both relaxed and actuated states to demonstrate an increase is sleeve diameter when in an actuated sleeve state. FIG. 22A depicts a transverse cross-section of the sleeve or sleeve-like article of manufacture 11 when in a relaxed state having a relaxed sleeve diameter as at 104. FIG. 22B depicts a transverse cross-section of a user's forearm 101 having a forearm diameter as at 105 greater in magnitude relative to the relaxed sleeve diameter 104. When donned upon the user's forearm 101, the sleeve or sleeve-like article of manufacture 11 has an actuated sleeve diameter on a par with the forearm diameter 105 and greater in magnitude than the relaxed sleeve diameter 104. It will thus be understood the fabric material preferably comprises certain elasticity for conforming the sleeve or sleeve-like article of manufacture 11 to the user's anatomy (e.g. forearm 101 or lower leg 103) as donned for preventing axial displacement along the length of the user's anatomy.

The sleeve or sleeve-like article or manufacture 11 preferably comprises a proximal open end as at 15; a distal open end as at 16; an anterior side as at 17; a posterior side as at 18; a sleeve axis as at 100; an inner sleeve surface as at 19; and an outer sleeve surface as at 20. The outer sleeve surface 20 preferably comprises fabric surfacing conducive for adhesively attaching the activity or behavior reinforcement badges as variously exemplified by the foundation or reference point badge 12, and the primary and secondary activity badges 13 and 14, respectively. The inner sleeve surface 19 preferably comprises fabric surfacing conducive for opposing a user's skin surface. In this last regard, it is contemplated that the outer sleeve surface 20 may comprise a hydrophilic material layer as at 90 for better adhesion characteristics and that the inner sleeve surface 19 may preferably comprise a hydrophobic material layer as at 91 for better moisture-wicking characteristics as diagrammatically depicted in FIG. 23.

Similar to Boy Scout or Girl Scout badges, the activity reinforcement badges according to the present invention otherwise referred to as Achieve Sleeve Badges are used to signify any accomplishment or completion of an activity. Once the participant has completed the task assigned or reached a benchmark in their curriculum, they are then given a Badge as a symbol of their progress. For example, a martial artist might receive a Badge for having technically perfected a kick in their school, or a summer camp attendee could be given a Badge for building a fire. Notably, the Achieve Sleeve Badges can function independent of the sleeve 11 as well. They can be placed on any article of clothing or accessory created from the same cotton or synthetic blend fabric with the sole purpose of symbolizing progress or accomplishment in any activity.

The purpose of the badge is to generate a feeling of pride, enthusiasm, or joy in the participant that they have accomplished a task to completion. It is known that receiving symbols, such as these badges, inspire participants to continue with the activity or think positively of their experience. It is the continued participation and positive feelings from patrons that will create a clear value to businesses using the Achieve Sleeve Badges in combination with the Achieve Sleeve.

The activity reinforcement badges or Achieve Sleeve Badges are preferably two-sided as generally depicted in FIGS. 24A-24C. On one side is a highly aggressive adhesive layer as at 25 that permanently adheres to fabrics with pressure from whomever is applying the Badge. There is no need for a heat source or sewing of any kind, it simply peels off a waxed paper backing and can be applied to a fabric surface in the orientation desired.

On the other side of the Badge is a printable fabric material, which can be designed and cut into any shape or size. It is printable in such a way so as to allow a user to design an image on a computer, then run the fabric through a printer that processes and applies an ink, in the design created, to the badge or fabric. Any color or design created can be totally unique to the patron. The design can signify steps accomplishments in a program, the completion of an activity, or even any form of branding appropriate to the business.

Manufacturing the Badges follows a simple process. It starts with sheets of blank badge material, which has a paper backing, the adhesive in the middle, and the printable fabric on the other side. The sheets are run through a printer to be inked with the predetermined design. Once the ink is done drying the badges are then cut with a guided machine, leaving individual badges with a paper backing. The Badges are machine washable and permanently adhere to fabric.

It is the intent of this section to provide a hypothetical scenario, in which a teacher in any given program might use the Badges in a very practical fashion. By going through this scenario in detail it will become apparent that the process for application of the Badge goes hand in hand with its creation. The benefit of positive reinforcement and acknowledging programming accomplishments is a corner stone for the value of the product and should be illuminated for complete understanding of functionality.

Upon entering an exemplary program, a child would receive an Achieve Sleeve in the color of their choosing. The entry level Achieve Sleeve might have a yellow binding at an upper boundary edge 66 near the proximal open end 15 and/or near the elbow, signifying that they are in the yellow level of the program. During their first class they would be introduced to the requirements of the yellow level and the skills they will need to learn to progress. Each of these requirements are represented with a primary activity badge or Skill Badge that they can earn once mastering the corresponding skill.

The participant would also be introduced to extra-curricular or secondary activity badges that denote accomplishments for actions that are not based on skill growth. For example, each week there may be a focus on a behavioral or "character theme" such as sharing, caring, or cooperation. Thus, a student or participant may earn a Character Badge for exhibiting behavior that is in keeping with the character theme of the week, but completely independent of their skill acquisition progress.

Another secondary activity badge may be an Attendance Badge, which is given out to any child who has attended the class that day. The main purpose of this badge is as a form of accountability and data tracking. If a student or participant has accumulated a number of Attendance Badges but very few Skill Badges or Character Badges, then the administrators, teachers and parents will recognize that adjustments need to be made inside the program or for the individual student or participant.

In an exemplary program, a teacher may carry Badges with them during the class, either in their pockets or a small pack they wear. If a child displays a mastery of a skill, or exhibits a behavior in keeping with the character theme of the week, then the teacher may pull the appropriate Badge from their pocket or pack, peel the backing off the Badge, and adhere the Badge to the Sleeve in the appropriate location and orientation. The teacher then asks the class to acknowledge the accomplishment of the student with a round of applause. The class then returns their previous activity.

It is the hope of the program that when a participant receives a Badge on their Sleeve during class it will generate a positive feeling of accomplishment in the recipient while simultaneously motivating classmates to earn their own badges. There are clear advantages to utilizing an instantaneous and permanent adhesion process for the Badges: 1) The participant receives a tangible, physical symbol at the very moment of their accomplishment, and 2) There is no added work or steps needed, such as sewing or ironing, in order for the Badge to be attached to the Sleeve, creating convenience for the participant or parent of the participant.

The foundation or reference point badge 12 according to the present invention is generally depicted and referenced at 12. The foundation or reference point badge 12 is preferably (adhesively) attachable to the outer sleeve surface 20 at the posterior side 18 and adjacent the proximal open end 15 as generally depicted in FIGS. 1, 5-10, and 12. The foundation or reference point badge 12 preferably comprises a straight proximal foundation badge edge as at 21 preferably positionable in parallel relation an upper boundary edge 66 of the sleeve 11; an arcuate distal foundation badge edge as at 22; an inner foundation badge side 23; and an outer foundation badge side as at 24. The inner foundation badge side 23 is preferably outfitted or provided with an adhesive layer as at 25. The outer foundation badge side 24 at the distal foundation badge edge 22 comprises a series of primary activity badge alignment demarcations as at 26. The series of primary activity badge alignment demarcations 26 are preferably aligned end-to-end along the distal foundation badge edge 22 for demarcating a series of activity badge alignment regions 27 in distal or outer adjacency to the distal foundation badge edge 21.

Comparatively referencing FIGS. 1-10, the reader will there consider that the activity or behavior reinforcement badges according to the present invention may be (adhesively) attached to the outer sleeve surface 20 in a sequential manner so as to reinforce the various activities or behaviors symbolized by the various badges for behavior reinforcement. In other words, as challenges 82, drills 81, and goals 80 are completed for any given primary activity as set forth in the curricula 92, a primary activity badge 13 may be attached to the sleeve or sleeve-like article of manufacture 11 in a preferred sequential manner so that the user or participant can display his or her achievements such that a record of achievement is displayed and continually built upon the sleeve or sleeve-like article of manufacture 11 in a sequential progression as particularly and comparatively depicted in FIGS. 4-10.

Figure 1A:
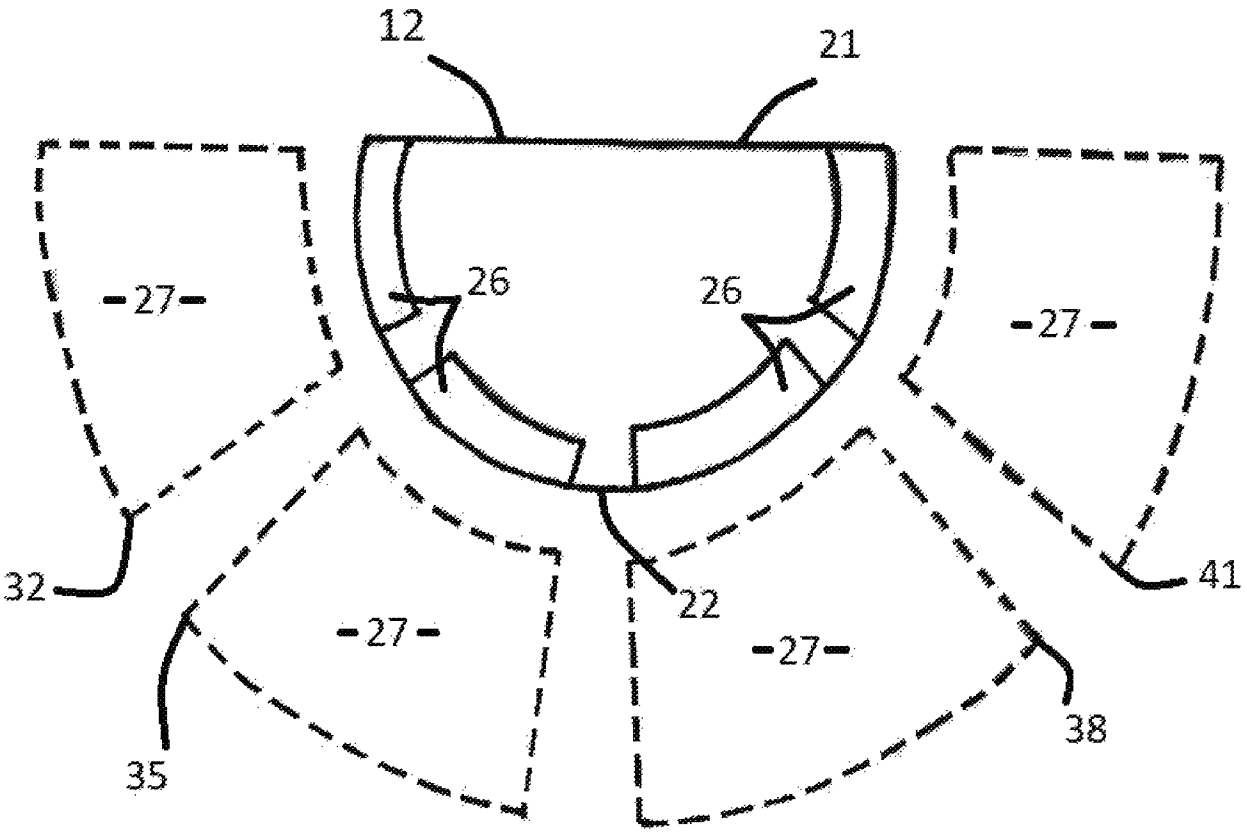
FIG. 1A is an enlarged plan view of a central foundation or reference point badge according to the present invention surrounded by a series of activity badge alignment regions for placing/positioning primary activity badges according to the present invention.
Figure 1B:
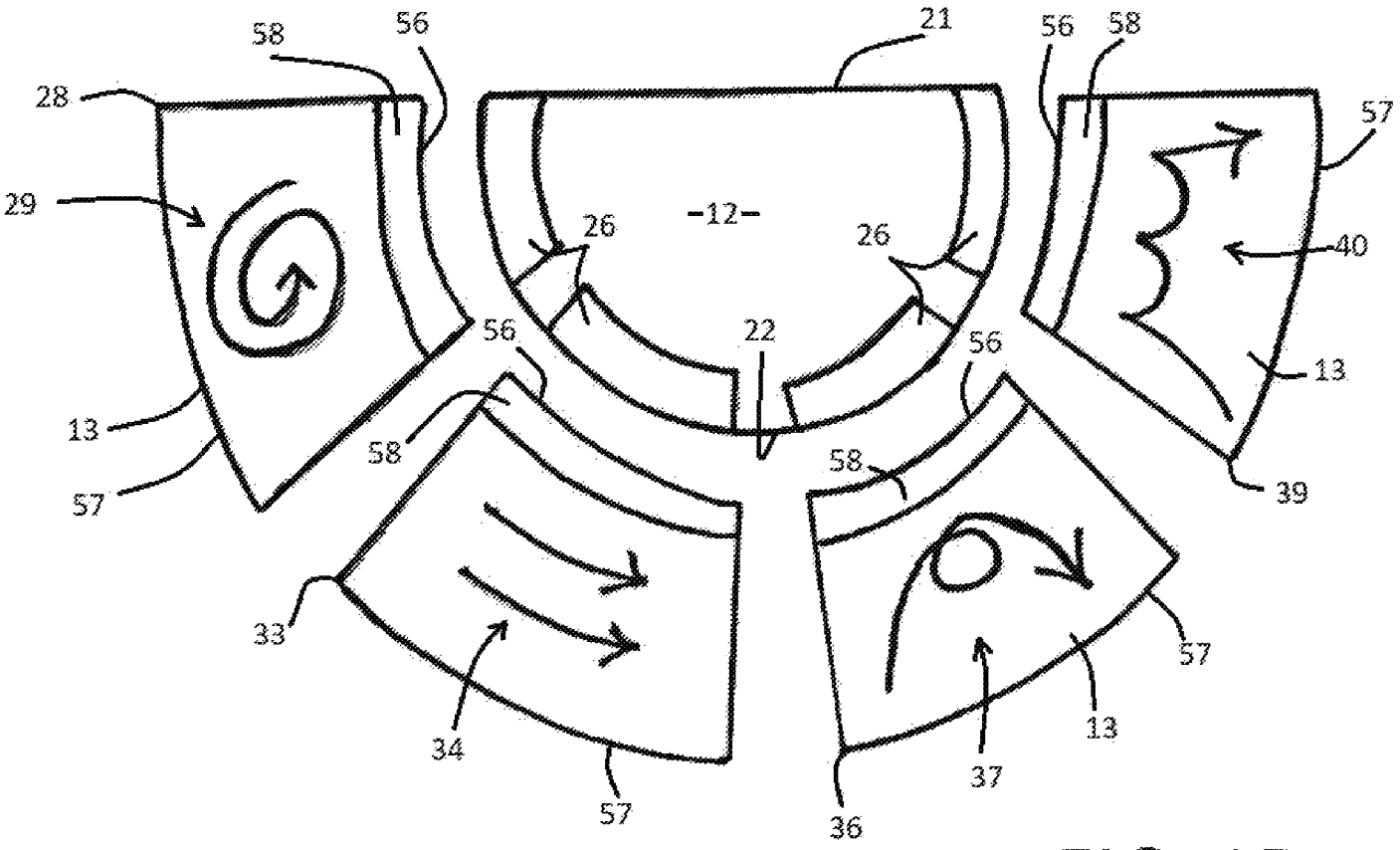
FIG. 1B is an enlarged plan view of a central foundation or reference point badge surrounded by a series of primary activity badges according to the present invention.
Figure 2:
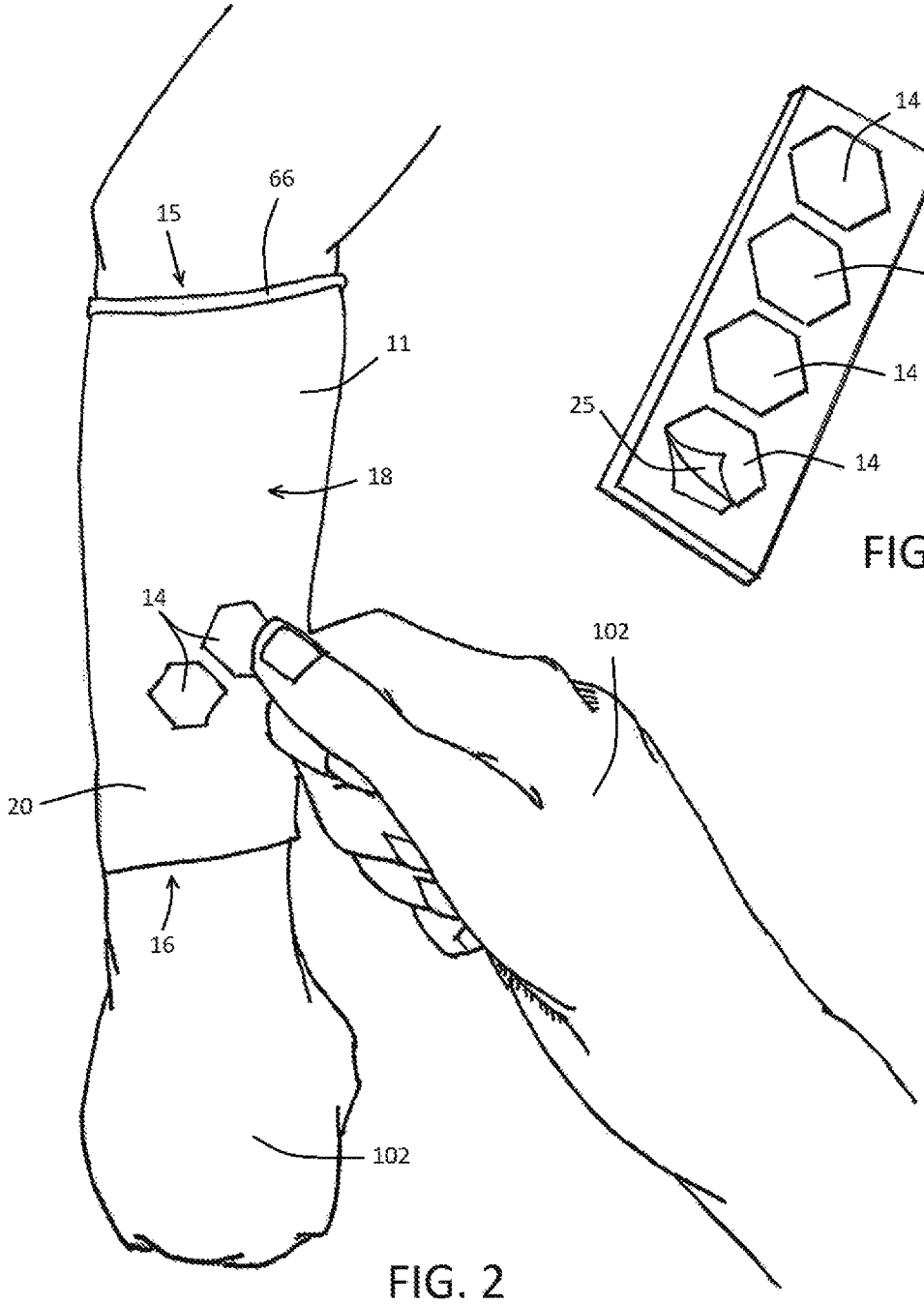
FIG. 2 is a perspective view of a participant wearing a preferred behavior enhancement and goal-setting apparatus according to the present invention with an instructor's hand adhesively applying a secondary activity badge to an outer sleeve surface of the sleeve element of the preferred behavior enhancement and goal-setting apparatus.
Figure 3:
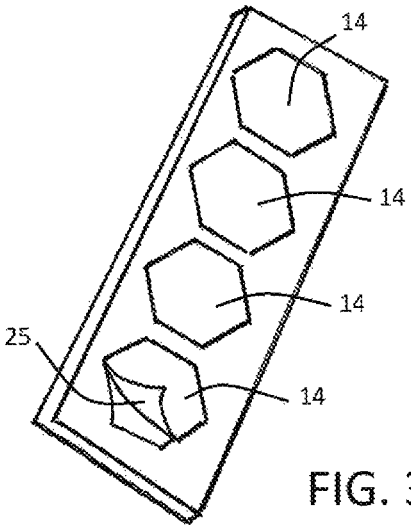
FIG. 3 is a perspective view of an adhesive strip of secondary activity badges according to the present invention with a bottom secondary activity badge being peeled from the adhesive strip.
Figure 4:
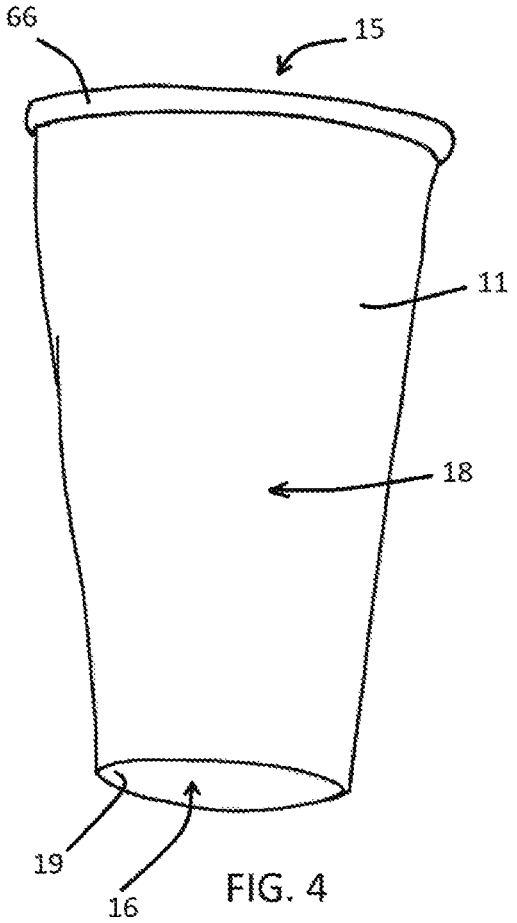
FIG. 4 is a first sequential slightly distal end view of a preferred sleeve element according to the present invention devoid of all activity reinforcement badges prior to application thereof to the sleeve element.
Figure 5:
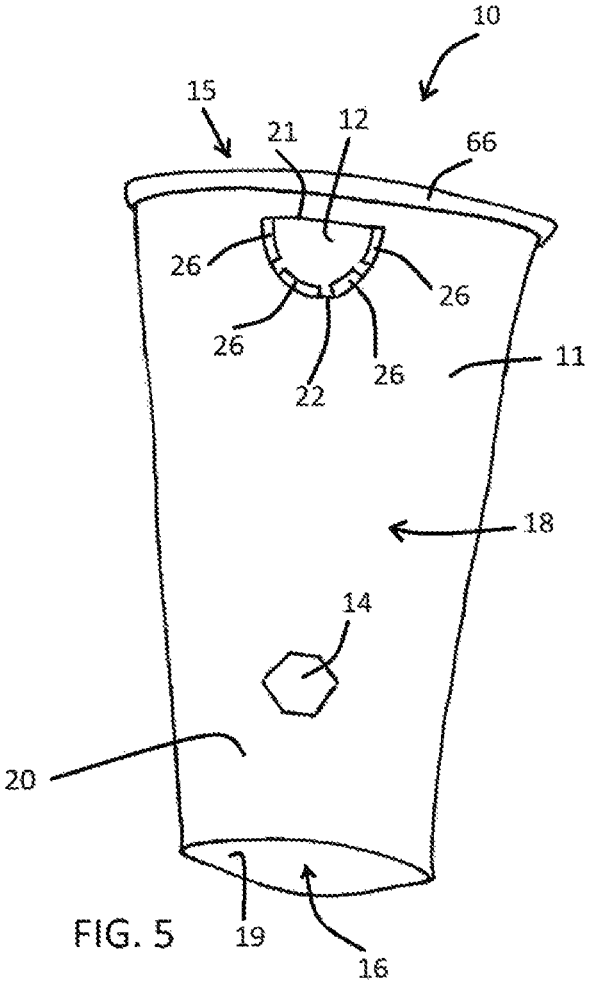
FIG. 5 is a second sequential slightly distal end view of the preferred sleeve element according to the present invention with a foundation or reference point badge being firstly attached to the outer sleeve surface adjacent the proximal open end, and a first secondary activity badge being attached to the outer sleeve surface adjacent the distal open end.

Comparatively referencing FIGS. 20 and 25A, the reader will there consider the "Rolling" type primary activity badge 28 may be achieved once the user demonstrates a certain mastery of the goals 80, drills 81, and challenges 82 as specified in the curriculum 92 for the rolling activity or skill set 93. The "Rolling" type primary badge 28 depicts a rolling symbol 29 upon an outer primary activity badge side 30. Once the user demonstrates a certain mastery of the goals 80, drills 81, and challenges 82 specified for the rolling skill set 93, the adhesive layer 25 of the inner primary activity badge side 31 may be adhesively attached to the activity badge alignment region 27 set aside for the "Rolling" type primary activity badge 28 as depicted and referenced at 32 in FIG. 1A.

Comparatively referencing FIGS. 20 and 25A, the reader will there consider the "Running" type primary activity badge 33 may be achieved once the user demonstrates a certain mastery of the goals 80, drills 81, and challenges 82 specified in the curriculum 92 for the running activity or skill set 95. The "Running" type primary badge 33 depicts a running symbol 34 upon the outer primary activity badge side 30. Once the user demonstrates a certain mastery of the goals 80, drills 81, and challenges 82 specified for the running skill set 95, the adhesive layer 25 of the inner primary activity badge side 31 may be adhesively attached to the activity badge alignment region 27 set aside for the "Running" type primary activity badge 33 as depicted and referenced at 35 in FIG. 1A.

Comparatively referencing FIGS. 20 and 25A, the reader will there consider the "Flipping" type primary activity badge 36 may be achieved once the user demonstrates a certain mastery of the goals 80, drills 81, and challenges 82 specified in the curriculum 92 for the flipping activity or skill set 94. The "Flipping" type primary badge 36 depicts a flipping symbol 37 upon the outer primary activity badge side 30. Once the user demonstrates a certain mastery of the goals 80, drills 81, and challenges 82 specified in the curriculum 92 for the flipping activity or skill set 94, the adhesive layer 25 of the inner primary activity badge side 31 may be adhesively attached to the activity badge alignment region 27 set aside for the "Flipping" type primary activity badge 36 as depicted and referenced at 38 in FIG. 1A.

Comparatively referencing FIGS. 20 and 25B, the reader will there consider the "Swinging" type primary activity badge 39 may be achieved once the user demonstrates a certain mastery of the goals 80, drills 81, and challenges 82 specified in the curriculum 92 for the swinging activity or skill set 96. The "Swinging" type primary badge 39 depicts a swinging symbol 40 upon the outer primary activity badge side 30. Once the user demonstrates a certain mastery of the goals 80, drills 81, and challenges 82 specified in the curriculum 92 for the swinging skill set 96, the adhesive layer 25 of the inner primary activity badge side 31 may be adhesively attached to the activity badge alignment region 27 set aside for the "Swinging" type primary activity badge 39 as depicted and referenced at 41 in FIG. 1A.

The behavior enhancement and goal-setting apparatus 10 according to the present invention thus contemplates the use of at least one primary activity badge 13. The primary activity badge(s) 13 are attachable to the outer sleeve surface 20 at the series of activity badge alignment regions 27 in distal or outer adjacency to the distal foundation badge edge 22. Each primary activity badge 13 preferably comprises a proximal primary activity badge edge as at 56 and a distal primary activity badge edge as at 57. Each primary activity badge 13 further preferably comprises a foundation badge alignment demarcation 58 at the proximal primary activity badge edge 56. The foundation badge alignment demarcations 58 aid the user in alignment of the respective primary activity badges 13 with the foundation or reference point badge 12 adjacent the distal foundation badge edge 22.

It will be recalled that the distal foundation badge edge 22 is preferably arcuate in form or comprises a distal foundation badge edge arc length. The series of primary activity badge alignment demarcations 26 are further preferably arcuate in form or preferably comprise foundation badge demarcation arc lengths as at 59. The arcuate foundation badge alignment demarcations 58 at the proximal primary activity badge edges 56 preferably comprise a primary activity badge demarcation arc length as at 60, which primary activity badge demarcation arc lengths 60 are preferably greater in magnitude than the foundation badge demarcation arc lengths 59 for aiding the user in spacing and aligning primary activity badges 13 in spaced relation to the acruate or non-linear distal foundation badge edge 22 of the foundation or reference point badge 12 as generally depicted in FIG. 26.

Referencing FIG. 26 through 30, the reader will there further consider the primary activity badge alignment demarcations 26 are arcuately aligned in end-to-end relation along the arcuate or non-linear distal foundation badge edge 22 wherein neighboring primary activity badge alignment demarcations 26 are aligned opposite a foundation badge gap 74 such that linear, laterally opposed first demarcation edges 70 laterally define the foundation badge gaps 74 and extend along edge planes as at 100. In other words, the foundation edge gaps 74 are spaced intermediate the series of primary activity badge alignment demarcations 26. Specifically referencing FIG. 30, the reader will there see the primary activity badge alignment demarcations 26 each preferably comprise an arcuate or non-linear, proximal primary activity badge alignment demarcation edge as at 68; an arcuate or non-linear, distal primary activity badge alignment demarcation edge as at 69; and linear, laterally opposed first demarcation edges as at 70. The linear, opposed first demarcation edges 70 define opposed sides of the foundation badge gaps 74 along the edge planes 100.

The foundation badge alignment demarcations 58 each preferably comprise an arcuate or non-linear, proximal foundation badge alignment demarcation edge as at 71 (coextensive with the proximal primary activity badge edge 56); an arcuate or non-linear, distal foundation badge alignment demarcation edge as at 72; and linear, laterally opposed second demarcation edges as at 73. The foundation badge alignment demarcations 58 are attached to the series of activity badge alignment regions 27 in distally spaced adjacency (as at spacing 101) to the arcuate or non-linear distal foundation badge edge 22 such that the linear, laterally opposed first demarcation edges 70 provide visual cues for aligning the linear, laterally opposed second demarcation edges 73 of the primary activity badges 13 along the edge planes 100.

In other words, the linear, opposed first demarcation edges 73 of each primary activity badge 13 are alignable along corresponding edge planes 100 for guiding placement of the primary activity badges 13 at the series of activity badge alignment regions 58 such that the edge planes 100 enable the user to properly (a) distance the primary activity badges 13 in gapped relation relative to the arcuate distal foundation badge edge 22 as at gaps 75 and (b) align the primary activity badges 13 in gapped relation (i) to one another as at gaps 76 and (ii) the foundation badge 12. The end result is that the primary activity badges 13 are (i) spaced in gapped relation to one another as at gaps 76 defined by the edge planes 100 and (ii) spaced in gapped relation relative to the foundation badge 12 in distal adjacency to the arcuate distal foundation badge edge 22 as at gaps 75.

It will be further noted that the series of arcuate or non-linear primary activity badge alignment demarcations 26 preferably comprise primary activity badge demarcation-matching coloration and that the foundation badge alignment demarcations 58 comprise foundation badge demarcation-matching coloration. In this regard, an exemplary coloration scheme or layout is generally depicted in FIG. 27. Referencing FIG. 27, the reader will there consider the primary activity badges 13 in clockwise manner from right-to-left, a first primary activity badge 13 comprising blue coloration depicted at hatch marking 62 upon both the arcuate or non-linear foundation badge alignment demarcation 58 and upon the symbol-bearing region 61 distal to the arcuate or non-linear foundation badge alignment demarcation 58. The symbol-bearing region bears a blue hatch marking referenced at 62'. The blue coloration as at hatch marking 62 on the arcuate or non-linear foundation badge alignment demarcation 58 matches the blue coloration as at hatch marking 62 born upon the corresponding arcuate or non-linear primary activity badge alignment demarcation 26. The demarcation-matching coloration aids the user in aligning the primary activity badges 13 in adjacency to the foundation badge 12 via a color-matched badge alignment demarcation pairing.

The reader will note the different sizes in hatch markings 62 and 62'. The difference in sizes between match markings 62 and 62' denotes different shades of blue as practiced in the preferred embodiment. The behavior enhancement and goal-setting apparatus 10 according to the present invention contemplates a color-matched badge alignment demarcation pairing as at color matched hatch markings 62 and further contemplates a first color shade as at 62 whereby the primary activity badges 13 each further preferably comprise a second color shade as at 62' distal to the foundation badge alignment demarcation 58 within the symbol-bearing regions 61 of the primary activity badges 13.

A second primary activity badge 13 comprising green coloration is depicted at hatch marking 63 upon both the foundation badge alignment demarcation 58 and upon the symbol-bearing region 61 distal to the foundation badge alignment demarcation 58 and referenced at 63'. The green coloration as at hatch marking 63 on foundation badge alignment demarcation 58 matches the green coloration as at hatch marking 63 born upon the corresponding primary activity badge alignment demarcation 26. The reader will note the different sizes in hatch markings 63 and 63'. The difference in sizes between match markings 63 and 63' denotes different shades of green as practiced in the preferred embodiment in keeping with the foregoing descriptions.

A third primary activity badge 13 comprising yellow coloration is depicted at hatch marking 64 upon both the foundation badge alignment demarcation 58 and upon the symbol-bearing region 61 distal to the foundation badge alignment demarcation 58 and referenced at 64'. The yellow coloration as at hatch marking 64 on foundation badge alignment demarcation 58 matches the yellow coloration as at hatch marking 64 born upon the corresponding primary activity badge alignment demarcation 26. The reader will note the different sizes in hatch markings 64 and 64'. The difference in sizes between match markings 64 and 64' denotes different shades of yellow as practiced in the preferred embodiment in keeping with the foregoing descriptions.

A fourth primary activity badge 13 comprising red coloration is depicted at hatch marking 65 upon both the foundation badge alignment demarcation 58 and upon the symbol-bearing region 61 distal to the foundation badge alignment demarcation 58 and referenced at 65'. The red coloration as at hatch marking 65 on foundation badge alignment demarcation 58 matches the red coloration as at hatch marking 65 born upon the corresponding primary activity badge alignment demarcation 26. The reader will note the different sizes in hatch markings 65 and 65'. The difference in sizes between match markings 65 and 65' denotes different shades of red as practiced in the preferred embodiment in keeping with the foregoing descriptions.

Comparatively referencing FIG. 28 versus FIG. 29, the reader will there note that the sleeve or sleeve-like article of manufacture 11 may preferably comprise a color-coded upper boundary edge 66 adjacent the proximal open end 15. FIG. 28 depicts a color-coded upper boundary edge 66 outfitted with yellow coloration as at hatch marking 64. In this regard, the reader will further comparatively reference FIG. 25A, and the header 67 of the set of curricula 92 there depicted denoting a "yellow" class. As participants complete the curricula 92 of the "yellow" class, the participants graduate to a new set of curricula 92 and when entering a new set of curricula 92, a new behavior enhancement and goal-setting apparatus 10 may be preferably provided as outfitted with a new color-coded upper boundary edge 66 of differing coloration.

A "red" class is denoted by hatch marking 65 upon the upper boundary edge 66 in FIG. 29. The behavior enhancement and goal-setting apparatus 10 according to the present invention may provide the basis for a behavior enhancement and goal-setting system comprising a series of behavior enhancement and goal-setting apparatuses 10, each of which may bear a color-coded upper boundary edge 66. The behavior enhancement and goal-setting system according to the present invention may thus be said to comprise a first sleeve 11 and at least one second sleeve 11 substantially identical to the first sleeve 11 but for a differently colored upper boundary edge 66 or differently colored portion of the sleeve(s) 11. The first sleeve 11 comprises a first color-coded upper boundary edge 66 or portion at the proximal open end 15, the first color-coded upper boundary edge 66 denotes a first set of curricula 92 associated with a first color (e.g. a "yellow" class). The second sleeve 11 in the series may comprises a second color-coded upper boundary edge 66 or portion at the proximal open end 15 for denoting a second set of curricula 92 associated with a second color (e.g. a "red" class). The second sleeve 11 may be awarded to the user upon the user's completion of the first set of curricula 92.

Referencing FIG. 25B, the reader will there consider a "bonus badges" portion 97 portion of the curricula 92. The bonus badges portion 97 of the curricula 92 lists certain other secondary skills and attributes of the curricula 92 that contribute to positive behavior development within the curricula 92 such as speed, skill, strength, courage, caring, and creativity. Bonus badges may be awarded when behaviors within the respective categories are witnessed by the development team or coaches within the activity setting. The behavior enhancement and goal-setting apparatus 10 according to the present invention thus contemplates the inclusion of at least one secondary activity badge 14, which secondary activity badge(s) comprise an outer secondary activity badge side 48 and an inner secondary activity badge side 49 with an adhesive layer 25. The adhesive layer 25 of the inner secondary activity badge side 49 is preferably attachable to the outer sleeve surface 20 in distal adjacency to the series of activity badge alignment regions 27 at the posterior side 18 in proximal adjacency to the distal open end 16.

A speed type bonus badge or secondary activity badge 14 is generally depicted and referenced at 42 having a speed type symbol 50 thereupon; a skill type bonus badge or secondary activity badge 14 is generally depicted and referenced at 43 having a skill type symbol 51 thereupon; a strength type bonus badge or secondary activity badge 14 is generally depicted and referenced at 44 having a strength type symbol 52 thereupon; a courage type bonus badge or secondary activity badge 14 is generally depicted and referenced at 45 having a courage type symbol 53 thereupon; a caring type bonus badge or secondary activity badge 14 is generally depicted and referenced at 46 having a caring type symbol 54 thereupon; and a creativity type bonus badge or secondary activity badge 14 is generally depicted and referenced at 47 having a creativity type symbol 55 thereupon.

While the above descriptions contain much specificity, this specificity should not be construed as limitations on the scope of the invention, but rather as an exemplification of the invention. In certain embodiments, the basic invention may be said to essentially teach or disclose a behavior enhancement and goal-setting apparatus as at 10 for providing a user with a physical representation of the user's progress in an activity with a predetermined curriculum so as to reinforce behavior in the activity. The behavior enhancement and goal-setting apparatus 10 according to the present invention may be said to essentially comprise a sleeve as at 11, and a foundation or reference point badge as at 12.

The sleeve 11 is primarily illustrated as beginning at the wrist and completing just short of the elbow or is preferably donned upon the entire length of a participant's forearm. However, the sleeve can be any size on the forearm in accordance with the desire of the company or program utilizing the product. Should the purchaser choose to have a shorter sleeve that only partially covers the forearm, or longer so that it extends past the elbow to just below the deltoid, those choices would have no bearing on the functionality of the product.

The sleeve also functions equally well on the lower leg or calf or thigh muscle. With some simple adjustments a client could place the product on either of those areas of the body and it would still be appropriate for rigorous activity and successfully display the activity reinforcement badges in keeping with the behavior modification aspects of the present invention. Moreover, the sleeve 11 may be attached to another form-fitting product, such as a compression sleeve or rash guard shirt, and still function according to the design and application of the product. This adjustment would allow the wearer the dual benefit of whatever the secondary product, such as the aforementioned compression sleeve, and the activity reinforcement badges or Achieve Sleeve Badges.

The sleeve or sleeve-like article of manufacture 11 is preferably formed from form-fitting fabric material having certain elasticity, and preferably comprises a proximal open end, a distal open end, an anterior side, a posterior side, a sleeve axis, an inner sleeve surface, and an outer sleeve surface. The outer sleeve surface primarily receives activity reinforcement badges, and inner sleeve surfacing primarily opposes or engages a user's anatomy or skin surface exemplified by a user's forearm or lower leg as alternatively outfitted with other structures such as a compression sleeve.

While it is the intent of the designer to use the Badges on the Sleeve, as noted, it must be acknowledged that the application of the Badges can and will function on any fabric similar to that of the Sleeve. And, so, the application opportunities for the product can be extended to any product meeting the fabric criteria for the adhesive, meaning any clothing or accessory created with cotton or blended material. For example, a person or entity could design, print, and cut the Badge product and then adhere it to a cotton T-shirt for the purpose of acknowledging the completion of any activity created by said person or entity.

The Badges can also be designed with the human body's unique shaping in mind. For example: A badge could be designed and cut in order to fit precisely around the wrist, or to follow the contours of the forearm in a way that accentuates the anatomy. If the product were to extend past the elbow, or the knee, a Badge, or multiple badges, could be created to fit appropriately around the joint in a safe and desirable fashion. All of this can be done while simultaneously achieving the product goals.

The foundation badge according to the present invention is preferably attached to the outer sleeve surface at the posterior side and proximal open end, and comprises a proximal foundation badge edge and a distal foundation badge edge. The distal foundation badge edge comprises a series of primary activity badge alignment demarcations that aligned end-to-end along the distal foundation badge edge for demarcating a series of activity badge alignment regions upon the outer sleeve surface in distal adjacency to the distal foundation badge edge.

The activity reinforcement badges according to the present invention, including the foundation or reference point badge 12, the primary activity badges 13, and the secondary activity badges 14, are preferably adhesively attachable to the outer sleeve surface, but could conceivably also be attached to the outer sleeve surface in any number of ways, including permanent stitching and hook and loop fastening means. The behavior enhancement and goal setting apparatus according to the present invention further contemplates that at least one primary activity badge as at 13 is preferably attachable to the outer sleeve surface at an activity badge alignment region in distal adjacency to the distal foundation badge edge.

The primary activity badge comprises a proximal primary activity badge edge and a distal primary activity badge edge. The primary activity badge further preferably comprises a foundation badge alignment demarcation at or adjacent the proximal primary activity badge edge. The foundation badge alignment demarcations help the user or participant align the primary activity badges with the foundation badge at or adjacent the distal foundation badge edge. The distal foundation badge edge is preferably arcuate, the series of primary activity badge alignment demarcations each comprise a foundation badge demarcation arc length. The foundation badge alignment demarcation at the proximal primary activity badge edge comprises a primary activity badge demarcation arc length such that the primary activity badge demarcation arc lengths are greater in magnitude than the foundation badge demarcation arc lengths for aiding the user in aligning the primary activity badge in spaced relation to the distal foundation badge edge.

The series of primary activity badge alignment demarcations may preferably comprise primary activity badge-matching coloration, and the primary activity badges may preferably comprise foundation badge demarcation-matching coloration. The foundation badge demarcation-matching coloration aids the user or participant in aligning the primary activity badges in adjacency to corresponding portions of the foundation badge via a color-matched badge alignment demarcation pairing comprising the primary activity badge alignment demarcations 26 and foundation badge alignment demarcations 58. The color-matched badge alignment demarcation pairing may further comprise a first color shade, and each primary activity badge may further preferably comprise a second color shade distal to the foundation badge alignment demarcation 58 within a symbol-bearing region 61 of each primary activity badge 13.

The behavior enhancement and goal setting apparatus according to the present invention may further preferably comprise a series of bonus or secondary activity badges as generally depicted and referenced at 14. Each secondary activity badge is also attachable to the outer sleeve surface in distal adjacency to the series of activity badge alignment regions 27 at the posterior side and in proximal adjacency to the distal open end. The primary and secondary activity badges 13 and 14 may both preferably comprise activity symbol markings that generally coincide with the activity that is to be reinforced.

The present invention further contemplates the provision of a behavior enhancement and goal-setting apparatus badge system for providing a user with a physical representation of the user's progress in an activity so as to reinforce behavior supportive of the activity. This aspect of the present invention contemplates the incorporation of at least the foundation badge, and at least one primary activity badge substantially as described hereinabove but usable in combination with any article of clothing such as a shirt, pant, or hat, which article of clothing has an outer clothing surface on par with the outer sleeve surface.

The at least one foundation badge is attachable to the outer clothing surface, and, as set forth hereinabove, preferably comprises a proximal foundation badge edge and a distal foundation badge edge. The distal foundation badge edge preferably comprises a series of primary activity badge alignment demarcations, which series of primary activity badge alignment demarcations are aligned end-to-end along the distal foundation badge edge for demarcating a series of activity badge alignment regions in distal adjacency to the distal foundation badge edge. Each primary activity badge is attachable to the outer clothing surface at a select activity badge alignment region in distal adjacency to the distal foundation badge edge.

Accordingly, although the behavior enhancement and goal-setting apparatus, and system, including the badge system for outfitting any article of clothing, according to the present invention have been described by reference to a number of different embodiments, aspects, and features, it is not intended that the novel combinations or assemblies be limited thereby, but that modifications thereof are intended to be included as falling within the broad scope and spirit of the foregoing disclosure, the appended drawings, and the following claims.

What is claimed is:

1. A behavior enhancement and goal-setting system for providing a user with a physical representation of the user's progress in an activity so as to reinforce behavior supportive of the activity, the behavior enhancement and goal-setting system comprising:

at least one sleeve formed from a fabric material and comprising a proximal open end, a distal open end, and an outer sleeve surface, the outer sleeve surface for receiving at least one activity reinforcement badge; and a foundation badge comprising a linear proximal foundation badge edge and an arcuate distal foundation badge edge, said foundation badge being attachable to the outer sleeve surface such that the linear proximal foundation badge edge is parallel to the proximal open end in spaced relation thereto, the arcuate distal foundation badge edge comprising a series of primary activity badge alignment demarcations;

the series of primary activity badge alignment demarcations being arcuately aligned end-to-end in spaced relation to one another along the arcuate distal foundation badge edge such that each primary activity badge alignment demarcation comprises linear, opposed first demarcation edges radially intersecting an arcuate inner demarcation edge and an arcuate outer demarcation edge coextensive with the arcuate distal foundation badge edge, the linear, opposed first demarcation edges of neighboring primary activity badge alignment demarcations being spaced from one another opposite a foundation badge gap;

the linear, opposed first demarcation edges of neighboring primary activity badge alignment demarcations extending along edge planes for demarcating a series of activity badge alignment regions in spaced adjacency to the arcuate distal foundation badge edge; and a series of primary activity badges, each primary activity badge of the series of primary activity badges comprising a foundation badge alignment demarcation, each foundation badge alignment demarcation comprising linear, opposed second demarcation edges, the linear, opposed second demarcation edges of each primary activity badge being alignable along corresponding edge planes for guiding placement of said primary activity badges at said activity badge alignment regions such that the edge planes enable the user to properly (a) distance said primary activity badges in gapped relation relative to the arcuate distal foundation badge edge and (b) align said primary activity badges in gapped relation to one another and the at least one foundation badge.

2. The behavior enhancement and goal-setting system of claim 1, the at least one sleeve comprising a first sleeve and at least one second sleeve, the first sleeve comprising a first color-coded portion, the first color-coded portion for denoting a first set of curricula associated with a first color, the at least one second sleeve comprising a second color-coded portion, the second color-coded portion for denoting a second set of curricula associated with a second color, the at least one second sleeve capable of being awarded to the user upon the user's completion of the first set of curricula.

3. A behavior enhancement and goal-setting sleeve arrangement for providing a user with a physical representation of the user's progress in an activity so as to reinforce behavior supportive of the activity, the behavior enhancement and goal-setting sleeve arrangement comprising:

a sleeve formed from a fabric material and comprising a proximal open end, a distal open end, and an outer sleeve surface, the outer sleeve surface for receiving activity reinforcement badges;

a foundation badge comprising a linear proximal foundation badge edge and an arcuate distal foundation badge edge, the foundation badge being attachable to the outer sleeve surface such that the linear proximal foundation badge edge is parallel to the proximal open end in spaced relation thereto, the arcuate distal foundation badge edge comprising a series of arcuate primary activity badge alignment demarcations;

the series of arcuate primary activity badge alignment demarcations being arcuately aligned end-to-end in spaced relation to one another along the arcuate distal foundation badge edge such that each primary activity badge alignment demarcation comprises linear, opposed first demarcation edges radially intersecting an arcuate inner demarcation edge and an arcuate outer demarcation edge coextensive with the arcuate distal foundation badge edge, the linear, opposed first demarcation edges of neighboring primary activity badge alignment demarcations being spaced from one another opposite a foundation badge gap;

the linear, opposed first demarcation edges of neighboring primary activity badge alignment demarcations extending along edge planes for demarcating a series of activity badge alignment regions in spaced adjacency to the arcuate distal foundation badge edge; and a series of primary activity badges, each primary activity badge of the series of primary activity badges comprising a foundation badge alignment demarcation, each foundation badge alignment demarcation comprising linear, opposed second demarcation edges, the linear, opposed second demarcation edges of each primary activity badge being alignable along corresponding edge planes for guiding placement of the primary activity badges at the series of activity badge alignment regions such that the edge planes enable the user to properly (a) distance the primary activity badges in gapped relation relative to the arcuate distal foundation badge edge and (b) align the primary activity badges in gapped relation relative to one another and the foundation badge.

4. The behavior enhancement and goal-setting sleeve arrangement of claim 3 wherein the series of arcuate primary activity badge alignment demarcations comprise primary activity badge demarcation-matching coloration, the series of primary activity badges comprising foundation badge demarcation-matching coloration, the foundation badge demarcation-matching coloration for aiding the user in aligning the series of primary activity badges in distally spaced adjacency to the arcuate distal foundation badge edge via a color-matched badge alignment demarcation pairing.

5. The behavior enhancement and goal-setting sleeve arrangement of claim 4 wherein the color-matched badge alignment demarcation pairing comprises a first color shade, the series of primary activity badges comprising a second color shade distal to the arcuate foundation badge alignment demarcation.

* * * * *